US008154577B2

(12) United States Patent
Tanaka et al.

(10) Patent No.: US 8,154,577 B2
(45) Date of Patent: Apr. 10, 2012

(54) APPARATUS AND METHOD OF CONTROLLING LIGHT LEVEL OF A LIGHT SOURCE, AND RECORDING MEDIUM STORING PROGRAM OF CONTROLLING LIGHT LEVEL OF A LIGHT SOURCE

(75) Inventors: Shinya Tanaka, Tokyo (JP); Hiroyuki Nagano, Tokyo (JP); Atsushi Hagiwara, Kawasaki (JP); Hideomi Fujimoto, Yokohama (JP); Satoshi Takano, Kodaira (JP)

(73) Assignee: Ricoh Company, Limited, Tokyo (JP)

( * ) Notice: Subject to any disclaimer, the term of this patent is extended or adjusted under 35 U.S.C. 154(b) by 193 days.

(21) Appl. No.: 12/656,222

(22) Filed: Jan. 21, 2010

(65) Prior Publication Data

US 2010/0189452 A1 Jul. 29, 2010

(30) Foreign Application Priority Data

Jan. 27, 2009 (JP) ..... 2009-015005

(51) Int. Cl.
*B41J 2/435* (2006.01)

(52) U.S. Cl. ..... 347/236; 347/246

(58) Field of Classification Search ..... 347/236, 347/237, 246, 247
See application file for complete search history.

(56) References Cited

U.S. PATENT DOCUMENTS

2008/0144132 A1* 6/2008 Koga ..... 358/475

FOREIGN PATENT DOCUMENTS

JP 06-255172 9/1994
JP 2000-071510 3/2000

* cited by examiner

*Primary Examiner* — Hai C Pham
(74) *Attorney, Agent, or Firm* — Harness, Dickey & Pierce, P.L.C.

(57) ABSTRACT

An apparatus and a method of controlling a light level of a light beam irradiated by a light source are provided. The light source is caused to irradiate the light beam having a light level determined based on a light level correction value for a specific main scanning position. The light level correction value is calculated based on light level change information indicating the change in the light level correction value for the specific main scanning position changes with respect to an initial light level correction value or a preceding light level correction value.

20 Claims, 12 Drawing Sheets

SHADING CORRECTION DATA

| | 1 | 2 | 3 | 4 |
|---|---|---|---|---|
| NUMBER OF AREAS | 2 | 4 | 8 | 12 |
| INCLINATION AMOUNT | 0 | 3 | 1 | 2 |
| INCLINATION DIRECTION (0 : − / 1 : +) | 0 | 0 | 0 | 1 |

SHADING CORRECTION DATA

| | 1 | 2 | 3 |
|---|---|---|---|
| NUMBER OF AREAS | 8 | 2 | 17 |
| INCLINATION AMOUNT | 2 | 0 | 1 |
| INCLINATION DIRECTION (0 : − / 1 : +) | 1 | 0 | 0 |

APPARATUS AND METHOD OF CONTROLLING LIGHT LEVEL OF A LIGHT SOURCE, AND RECORDING MEDIUM STORING PROGRAM OF CONTROLLING LIGHT LEVEL OF A LIGHT SOURCE

CROSS-REFERENCE TO RELATED APPLICATIONS

This patent application is based on and claims priority under 35 U.S.C. §119 to Japanese Patent Application No. 2009-015005, filed on Jan. 27, 2009, in the Japanese Patent Office, the disclosure of which is hereby incorporated herein by reference.

FIELD OF THE INVENTION

The present invention generally relates to an apparatus and a method of controlling the light level of a light source, and a recording medium storing a program of controlling the light level of a light source.

BACKGROUND

An image forming apparatus is usually provided with a light source, which emits a light beam through a rotatable polyhedron deflector onto a surface of a photoconductor to form a latent image thereon. The light beam emitted by the light source passes an optical scanning system such as a f-theta lens before it reaches the surface of the photoconductor. As the light beam passes the optical scanning system, the light level of the light beam may change according to the image height of the f-theta lens, thus resulting in the fluctuations in density of the latent image to be formed.

In order to solve this problem, the light level of the light beam to be emitted by the light source is controlled based on the light level of the light beam that reaches the surface of the photoconductor, for example, as described in the Japanese Patent Application Publication No. H06-255172. This approach, however, requires a light level detection sensor capable of detecting the light level of the light beam at the surface of the photoconductor, and an additional control circuit to control the light level of the light beam based on the detection result of the light level detection sensor.

The other approach for solving the above-described problem is to control the light level of the light beam based on shading correction data previously stored in a memory. For example, as described in the Japanese Patent Application Publication No. 2000-71510, using the shading correction data, the light level of the light beam to be emitted by the light source may be adjusted based on a specific position at which the light beam is to be scanned. This approach, however, requires a sufficient memory space as a sufficient number of shading correction values are needed to obtain a smooth shading correction curve.

SUMMARY

In view of the above, there is a need for providing an apparatus or a method of controlling the light level of the light beam emitted by the light source provided in the image forming apparatus, with high accuracy without requiring a complex structure.

Example embodiments of the present invention include a light level controlling apparatus including: a light source configured to irradiate a light beam; a rotatable deflector configured to rotate to scan the light beam irradiated by the light source to an image writing area in a main scanning direction to form an image on the image writing area; a detector provided outside the image writing area and configured to output a synchronization detection signal indicating the time when the light beam scanned by the rotatable deflector enters the image writing area; a storage unit configured to store light level correction data; and a light level controller configured to cause the light source to irradiate the light beam having a light level determined based on a light level correction value for a specific main scanning position. The light level correction data includes: an initial light level correction value indicating an initial light level of the light beam to be irradiated by the light source when the light beam enters the image writing area after the synchronization detection signal is output; and light level change information indicating the change in the light level correction value for the specific main scanning position with respect to the initial light level correction value. The light level correction value for the specific main scanning position indicating a light level of the light beam to be irradiated by the light source when the light beam scans at the specific main scanning position of the image writing area.

Example embodiments of the present invention includes a light level controlling method including: rotating a rotatable deflector to scan a light beam irradiated by a light source to an image writing area in a main scanning direction to form an image on the image writing area; outputting a synchronization detection signal indicating the time when the light beam scanned by the rotatable deflector enters the image writing area; storing light level correction data; and causing the light source to irradiate the light beam having a light level determined based on a light level correction value for a specific main scanning position. The light level correction data includes: an initial light level correction value indicating an initial light level of the light beam to be irradiated by the light source when the light beam enters the image writing area after the synchronization detection signal is output; and light level change information indicating the change in the light level correction value for the specific main scanning position with respect to the initial light level correction value. The light level correction value for the specific main scanning position indicating a light level of the light beam to be irradiated by the light source when the light beam scans at the specific main scanning position of the image writing area.

In addition to the above-described example embodiments, the present invention may be practiced in various other ways, for example, as a computer-readable program that causes a computer to carry out the above-described method or a recording medium storing the compute-readable program.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
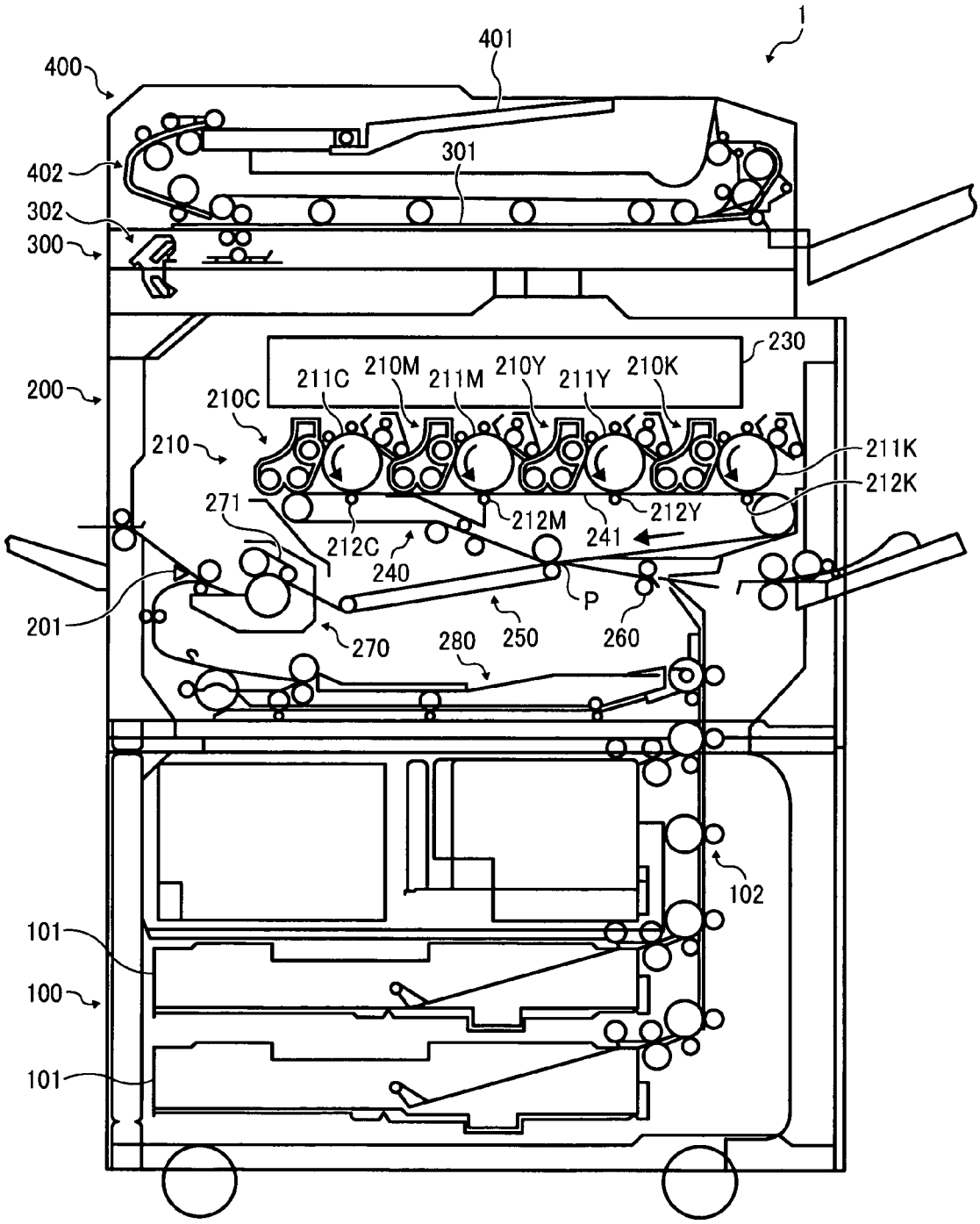
FIG. 1 is a schematic cross-sectional diagram illustrating a front view of a multifunctional apparatus (MFP) according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring to FIGS. 1 to 7, an apparatus and a method of controlling the light intensity level of a light beam to be emitted by a light source are explained according to an example embodiment of the present invention. For the descriptive purpose, in this example, the light intensity level may be referred to as the light level. FIG. 1 is a cross-sectional diagram illustrating the structure of a multi-functional apparatus (MFP) 1. The MFP 1, which functions as an image forming apparatus, is capable of performing an image forming operation such as scanning, copying, or printing.

In this example, the MFP 1 includes a sheet feeding device 100, a printer 200 provided above the sheet feeding device 100, and a scanner 300 provided above the printer 200. The MFP 1 further includes an automatic document feeder (ADF) 400, which is mounted on the top surface of the scanner 300. The MFP 1 further includes an operation panel 508 illustrated in FIG. 13. The operation panel 508 includes various operational keys such as a ten key and a start key, and a display such as a liquid crystal display. The operation panel 508 receives a user input, through the various operational keys, indicating an instruction for selecting an operation mode such as a data transfer mode or copy mode, an instruction for setting a magnification or reduction ratio for copying, etc. The operation panel 508 displays, on the display, the instruction input by the user through the operational keys or various information such as notification generated by the MFP 1 for the user. In the following example, the user inputs an instruction for setting various data such as shading correction data to be used for controlling image forming operation through the operation panel 508.

The printer 200 includes an image forming unit 210, an optical writing unit 230, an intermediate transfer unit 240 provided with an intermediate transfer belt 241, a secondary transfer unit 250, a registration roller pair 260, a fixing unit 270 provided with a fixing belt 271, a switch pawl 201, and a sheet reversing unit 280. In this example, the image forming unit 210 includes four process cartridges 210C, 210M, 210Y, and 210K, which may be collectively referred to as the process cartridges 210 and respectively provided for the colors of cyan (C), magenta (M), yellow (Y), and black (K). The process cartridges 210 are each provided with photoconductors 211C, 211M, 211Y, and 211K each having a drum-like shape. The process cartridges 210 each include a charger, a developer, a cleaner, a discharger, etc., in addition to the photoconductor 211.

The optical writing unit 230 irradiates a flux of light beams, which is modulated based on image data respectively prepared for the respective colors of cyan, magenta, yellow, and black, respectively onto the surfaces of the photoconductors 211C, 211M, 211Y, and 211K of the process cartridges 210 to form the latent images of the respective colors respectively thereon. More specifically, the optical writing unit 230 irradiates the light beams, which are modulated and deflected, onto the surfaces of the photoconductors 211, which are uniformly charged by the chargers of the process cartridges 210, to form the latent images of the respective colors. The developers of the process cartridges 210 each supply the toner of the respective colors from toner bottles to develop the latent images formed on the surfaces of the photoconductors 211 into the toner images of the respective colors. The toner images are then sequentially transferred to the surface of the intermediate transfer belt 241 of the intermediate transfer unit 240. The residual toner that resides on the surfaces of the photoconductors 211 after image transfer is removed by the cleaners of the process cartridges 210. The dischargers of the process cartridges 210 discharge the surfaces of the photoconductors 211 to prepare for another image forming operation.

The intermediate transfer belt 241 of the intermediate transfer unit 240 stretches over a plurality of rollers including a plurality of intermediate transfer rollers 212C, 212M, 212Y, and 212K. The intermediate transfer rollers 212C, 212M, 212Y, and 212K are each provided at the positions facing the corresponding photoconductors 211C to 211K via the intermediate transfer belt 241. The intermediate transfer belt 241, which is an endless belt, is rotated in the clockwise direction as indicated by the arrow shown in FIG. 1. When transferring the toner images, the intermediate transfer electric voltages are applied respectively to the intermediate transfer rollers 212C, 212M, 212Y, and 212K to cause the toner images to be sequentially transferred from the surfaces of the photoconductors 211 onto the intermediate transfer belt 241 to form a full-color composite toner image thereon. The color toner image is transferred to a recording sheet, which is transferred from the sheet feeding device 100, at a secondary transfer position P at which the secondary transfer unit 250 is made in contact with the intermediate transfer belt 241 to form a nip therebetween. The secondary transfer unit 250 transfers the recording sheet having the color toner image formed thereon to the fixing unit 270.

The printer 200 includes the registration roller pair 260, which is provided upstream of the secondary transfer position P in the sheet transfer direction. The recording sheet fed from the sheet feeding device 100 to the printer 200 is transferred through the registration roller pair 260. The printer 200 is provided with a printer controller, which controls the timing at which the recording sheet is fed from the registration roller pair 260 such that the recording sheet reaches the secondary transfer position P at a predetermined timing to receive the color toner image carried by the intermediate transfer belt 241 at the secondary transfer position P. In this manner, the color toner image formed on the intermediate transfer belt 241 is transferred onto the recording sheet at the secondary transfer position P, which is the nip formed between the secondary transfer unit 250 and the intermediate transfer belt 241. The recording sheet having the color toner image formed thereon is transferred to the fixing unit 270. The fixing unit 270 fixes the color toner image onto the recording sheet by heat and pressure, while the recording sheet is being carried toward the switch pawl 201.

The switch pawl 201 switches the sheet transfer path between a path that leads the recording sheet toward the outside of the MFP 1 and a path that leads the recording sheet toward the sheet reversing unit 280. When image forming is to be performed for both sides of the recording sheet, the switch pawl 201 causes the recording sheet to be transferred to the sheet reversing unit 280 after the image is formed on one side of the recording sheet. The sheet reversing unit 280 receives the recording sheet from the switch pawl 210 after the faces of the recording sheet are reversed, and the transfers the recording sheet through the registration roller pair 260 to the secondary transfer position P to form an image on the other side of the recording sheet.

The sheet feeding device 100 includes a plurality of sheet cassettes 101 and a sheet transfer device 102. The sheet cassettes 101 each store therein a stack of recording sheets having a specific size or a specific type such that various sizes or types of the recording sheet may be used by the MFP 1. In image forming operation, one recording sheet is separated from the stack of the recording sheets stored in one of the sheet cassettes 101, and fed toward the sheet transfer device 102. The sheet transfer device 102, which includes a plurality of rollers, transfers the recording sheet fed from the one of the sheet cassettes 101 to the printer 200.

The scanner 300 includes an exposure glass 301 and an image reading device 302. The image reading device 302 is capable of reading an original placed on the exposure glass 301 into image data. The ADF 400 is mounted on the top of the exposure glass 301 such that the ADF 400 may be opened or closed with respect to the surface of the exposure glass 301. When the ADF 400 is opened, the top surface of the exposure glass 301 is exposed such that the user is allowed to place the original on the exposure glass 301. When the ADF 400 is closed after the original is placed on the exposure glass 301, the ADF 400 functions as a pressure plate by pressing the original against the exposure glass 301. The ADF 400 is provided with a document tray 401 and a document feeder 402. When a plurality of pages of the original is provided on the document tray 401, the original is fed, one page by one page, toward the exposure glass 301 by the document feeder 402 to an image reading section at which the original is read by the image reading device 302. After the original is read, the original is discharged onto the surface of the ADF 400 by the document feeder 402.

Figure 13:
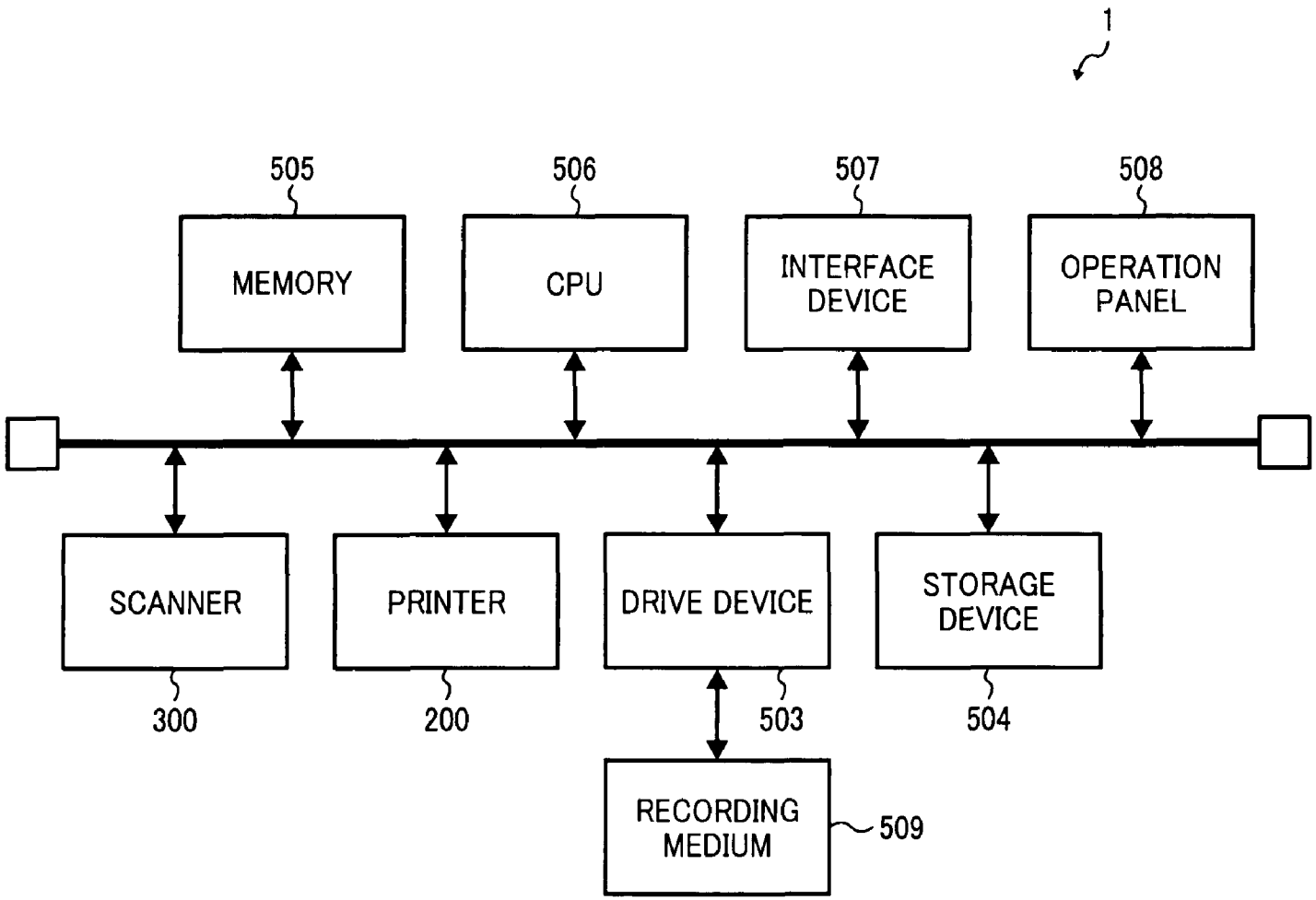
FIG. 13 is a schematic block diagram illustrating a hardware structure of the MFP of FIG. 1.

Referring now to FIG. 13, a structure of the MFP 1 is explained according to an example embodiment of the present invention. The MFP 1 includes the scanner 300, the printer 200, the operation panel 508, a memory 505, a central processing unit (CPU) 506, an interface device 507, a drive device 503, and a storage device 504, which are connected with one another through a bus.

The memory 505 may be implemented by any desired memory such as a read only memory (ROM) or a random access memory (RAM). The CPU 506 is any desired processor capable of controlling operation to be performed by the MFP 1. The interface device 507 may be implemented by a network interface circuit, which allows the MFP 1 to communicate with another apparatus via a network. The drive device 503 reads from or writes onto a recording medium 509. The storage device 504 stores various data such as image data processed by the MFP 1.

Figure 2:
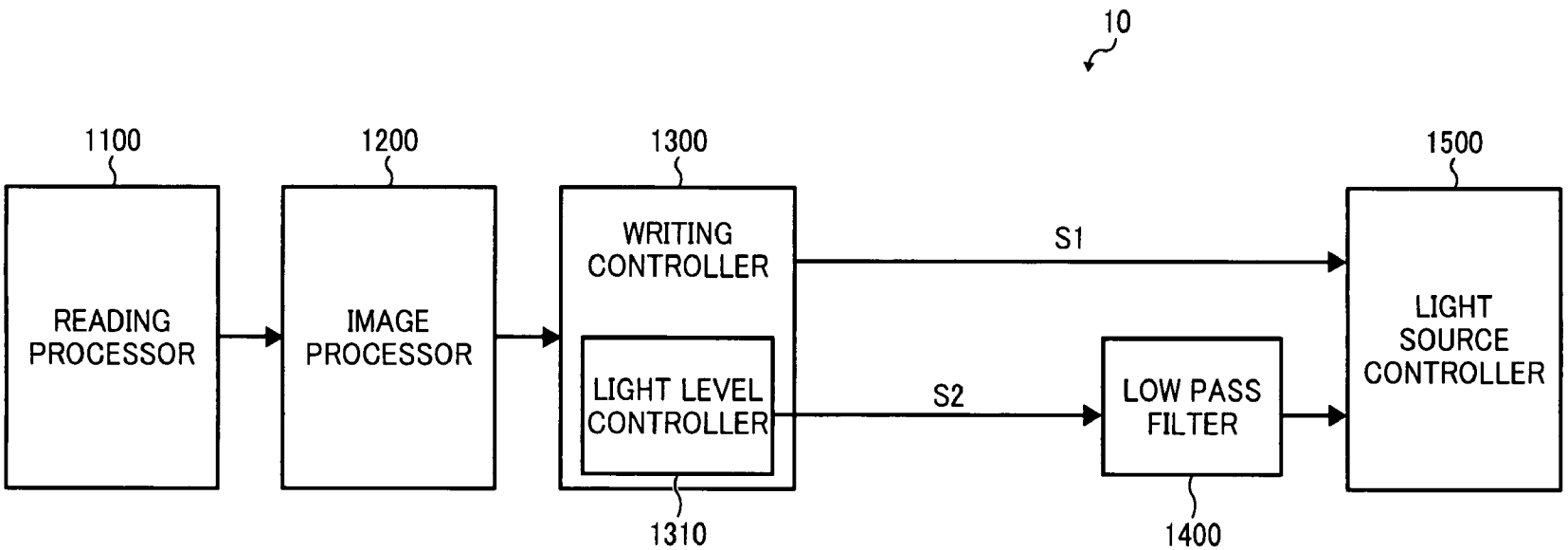
FIG. 2 is a schematic block diagram illustrating an image writing controller of the MFP of FIG. 1.

As illustrated in FIGS. 2 and 13, the MFP 1 is additionally provided with an image writing controller 10 capable of controlling image writing operations performed by the optical writing unit 230 of the MFP 1. The image writing controller 10 includes a reading processor 1100, an image processor 1200, a writing controller 1300, a low pass filter 1400, and a light source controller 1500.

Figure 3:
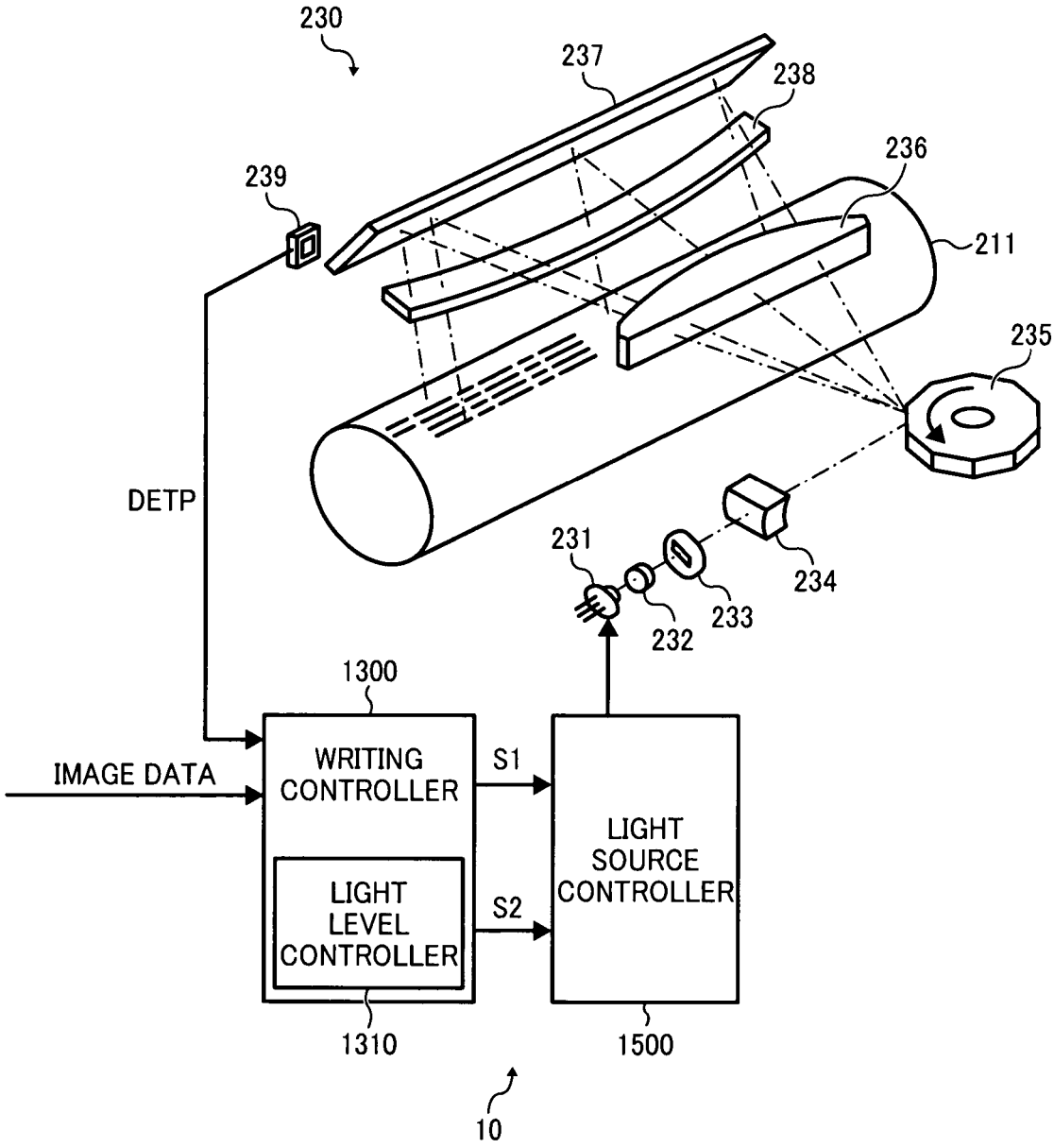
FIG. 3 is a perspective view illustrating an optical writing unit of the MFP of FIG. 1, which is controlled by the image writing controller of FIG. 2.

In this example, the functions of the image writing controller 10 may be performed by the CPU 506 of FIG. 13. The memory 505 stores an image writing control program for controlling the optical writing unit 230 of the MFP 1 to perform image writing operation. More specifically, according to the image writing control program stored in the memory 505, the CPU 506 causes the optical writing unit 230 of the MFP 1 to perform image writing operation including light level control operation. For example, as described below referring to FIG. 3, the image writing controller 10 causes the optical writing unit 230 to emit the light beam having a predetermined light level toward the surface of the photoconductor 211 such that the light level that reaches the surface of the photoconductor 211 is made uniform in the main scanning direction, thus improving the quality of the resultant latent image. As illustrated in FIG. 3, the light source of the optical writing unit 230 is implemented as a laser diode (LD) array 231.

Further, in this example, the image writing control program may be stored in any desired computer-readable recording medium such as the recording medium 509 illustrated in FIG. 13. Examples of the recording medium 509 include, but not limited to, ROM, EEPROM (Electrically Erasable and Programmable Read Only Memory), EPROM, flash memory, flexible disk, CD-ROM (Compact Disc Read Only Memory), CD-RW (Compact Disc Rewritable), DVD (Digital Video Disc), SD (Secure Digital) card, and MO (Magneto-Optical) disc. Alternatively, the image writing control program may be previously stored in the storage device 504. In either case, the image writing control program may be loaded onto the memory 505 to cause the optical writing unit 230 of the MFP 1 to perform image writing operation according to the loaded image writing control program. The image writing control program may be written in any desired computer-executable programming language including the legacy programming language such as assembler, C, C++, C#, Java or the object-oriented programming language. Further, the image writing control program may be distributed in any desired form, for example, as the instructions stored in any desired recording medium or the instructions that may be transferred through a network.

Referring to FIG. 2, the reading processor 1100 and the image processor 1200 are incorporated in a single board, which may be referred to as an image processor controller board and is arranged closely to a main controller board functioning as a main controller for controlling the respective sections of the MFP 1. The writing controller 1300, the low pass filter 1400, and the light source controller 1500 are incorporated into a laser diode (LD) board that is arranged closely to the optical writing unit 230 to control the optical writing unit 230.

The scanner 300 scans the original into an optical image, and performs photo-electric conversion on the optical image to generate analog image data by using a charged coupled device (CCD). The CCD outputs the analog image data to the reading processor 1100. The reading processor 1100 applies various processing such as sampling, analog/digital conversion, and shading correction to the analog image data, and outputs the processed image data to the image processor 1200. The shading correction corrects variance in intensity of the image data attributable to the sensitivity of the CCD. The image processor 1200 performs various processing such as scaling, rotation, or edge processing, on the processed image data. The image processor 1200 further converts the processed image data to multivalue image data such as 4-bit 16-value image data, and outputs the multivalue image data to the writing controller 1300.

The writing controller 1300, which is implemented by an ASIC (Application Specification Integrated Circuit), includes a light level controller 1310.

The writing controller 1300 generates a light on/off signal S1 and a light level control signal S2 based on the image data received from the image processor 1200. The light source controller 1500 controls the on or off of the LD array 231 of the optical writing unit 230 according to the light on/off signal S1 output from the writing controller 1300. The light level control signal S2 is output to the low pass filter 1400 for smoothing processing, and output to the light source controller 1500 after smoothing processing is applied. The light source controller 1500 controls the level of the light beam to be irradiated by the LD array 231 based on the light level control signal S2.

The low pass filter 1400 removes high frequency components or noise components from the light level control signal S2 before outputting the light level control signal S2 to the light source controller 1500.

The light source controller 1500 controls the on or off of the LD array 231 and the light level of the light beam irradiated by the LD array 231, respectively based on the light on/off signal S1 received from the writing controller 1300 and the light level control signal S2 input by the low pass filter 1400.

As illustrated in FIG. 3, the optical writing unit 230 includes the LD array 231, which functions as the light source capable of irradiating the flux of the light beams. The optical writing unit 230 further includes a collimator lens 232, an aperture 233, a cylindrical lens 234, a polygon mirror 235 functioning as a rotatable polyhedron deflector, an f-theta lens 236, a deflective mirror 237, a protective glass 238, and a synchronization detection sensor 239. In this example, the f-theta lens 236 is provided so as to convert the light beam scanned by the polygon mirror 235 with the constant angle into the light beam scanned onto the surface of the photoconductor 211 with the constant linear speed. The LD array 231, which includes a plurality of light sources such as a plurality of laser diodes (LDs), irradiates the light beam toward the surface of the photoconductor 211. In this example, the optical writing unit 230 illustrated in FIG. 3 is provided for each one of the respective colors of Y, M, C, and K. More specifically, the LD array 231 provided for a specific color irradiates the laser beam modulated based on the image data of the specific color toward the surface of the photoconductors 211 provided for the specific color. In this example, the plurality of LDs of the LD array 231 may be arranged in the sub-scanning direction. Further, for simplicity, the low pass filter 1400 is not shown in FIG. 3.

The light beam irradiated by the LD array 231 is caused to have a predetermined shape as it passes through the collimator lens 232, the aperture 233, and the cylindrical lens 234, before it reaches the surface of the polygon mirror 235. The polygon mirror 235 is kept rotating at a high rotational speed by a polygon motor. With this rotation, the light beam emitted to the polygon mirror 235 is deflected toward the f-theta lens 236 and the deflective mirror 237, and scanned in the main scanning direction in parallel with the axial direction of the photoconductor 211. The f-theta lens 236 performs the optical face tangle error correction on the light beam deflected by the polygon mirror 235 before the light beam reaches the deflective mirror 237. The deflective mirror 237 adjusts the angle in which the light beam is deflected so as to cause the light beam to form a spot having a predetermined beam size onto the surface of the photoconductor 211.

The optical writing unit 230 includes the synchronization detection sensor 239, which is provided outside an image writing area in the main scanning direction. The image writing area is an area in which the light beam deflected by the polygon mirror 235 is scanned to form the latent image. As described below referring to FIG. 6B or 7B, the image writing area may be divided into a plurality of divided areas in the main scanning direction according to the shading characteristics of the optical scanning system. In this example, the synchronization detection sensor 239 is provided at a position located upstream of the position where the light beam is firstly scanned as the light beam linearly moves in the main scanning direction. The synchronization detection sensor 239 detects the light beam which is deflected by the polygon mirror 235, and outputs a synchronization detection signal DETP to the writing controller 1300. In this example, the synchronization detection signal DETP is used to indicate the time when the light beam, which is deflected by a specific surface of the polygon mirror 235, enters the image writing area for each line of the image data.

Figure 4:
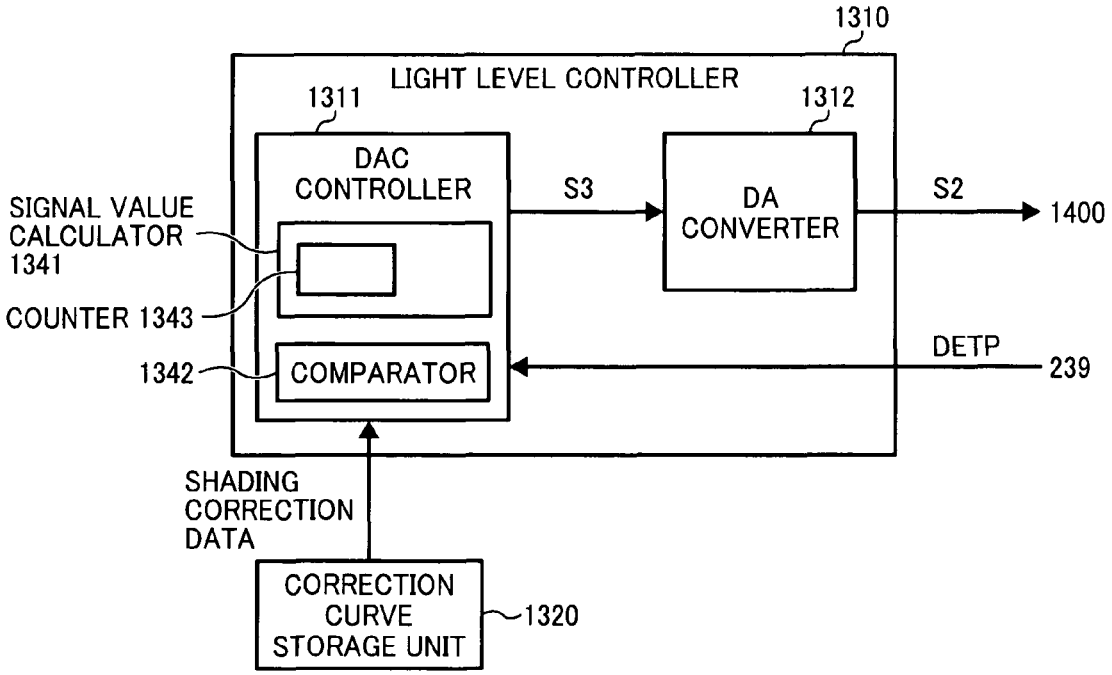
FIG. 4 is a schematic block diagram illustrating a light level controller included in the image writing controller of FIG. 2.

Referring to FIG. 4, the light level controller 1310 of the writing controller 1300 includes a digital analog converter (DAC) controller 1311 and a digital analog (DA) converter 1312. The DAC controller 1311 is connected to a correction curve storage unit 1320.

The correction curve storage unit 1320, which may be implemented by the memory 505 of FIG. 13, stores therein shading correction data previously provided for correcting the light level of the light beam to be irradiated onto the surface of the polygon mirror 235. The shading correction data includes an initial light level correction value, which is previously determined so as to cause the LD array 231 to irradiate a light beam having a predetermined light level when the light beam enters the image writing area to start image forming operation. In this example, the initial light level correction value may be expressed in terms of voltage value. The shading correction data further includes information indicating the change in light level correction value with respect to the initial light level correction value or the light level correction value obtained for the preceding unit area, which may be referred to as the "light level change information". For example, referring to FIGS. 6A and 7A, the shading correction data includes, for each divided area of the image writing area, the number of continuous unit areas included in a specific divided area ("number of areas"), the inclination amount indicating how much degree the light level correction value should be changed or inclined with respect to the initial light level correction value or the light level correction value obtained for the unit area preceding a specific unit area ("inclination amount"), and the inclination direction indicating whether the change or the incline in the light level correction value is positive or negative with respect to the initial light level correction value or the light level correction value obtained for the unit area that precedes the specific unit area ("inclination direction"). In this example, the value "0" indicates that the incline is negative, and the value "1" indicates that the incline is positive.

Figures 6A, 6B:
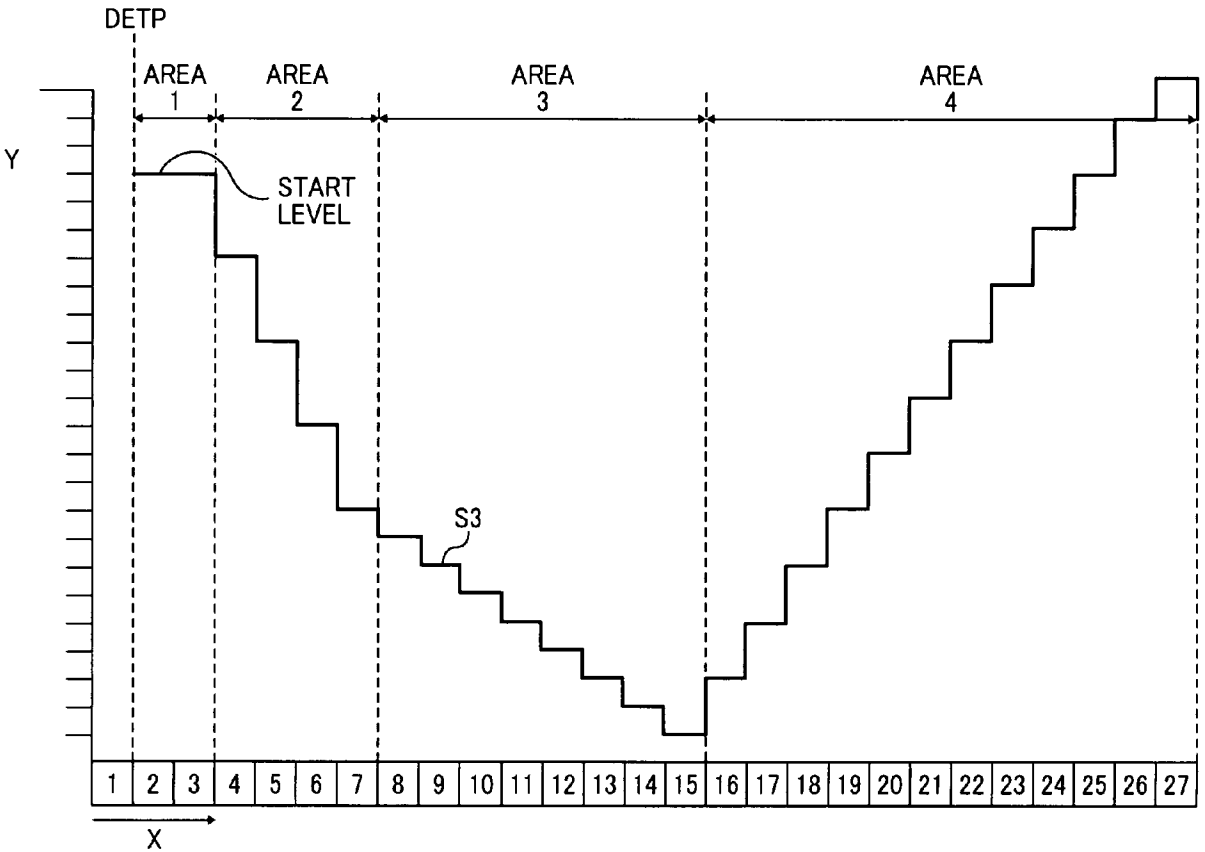
FIG. 6A is example shading correction data stored in the MFP of FIG. 1.
FIG. 6B is an illustration for explaining operation of correcting the light level of the light beam to be emitted by the light source of the optical writing unit of FIG. 3, performed by the image writing controller of FIG. 2.
Figures 7A, 7B:
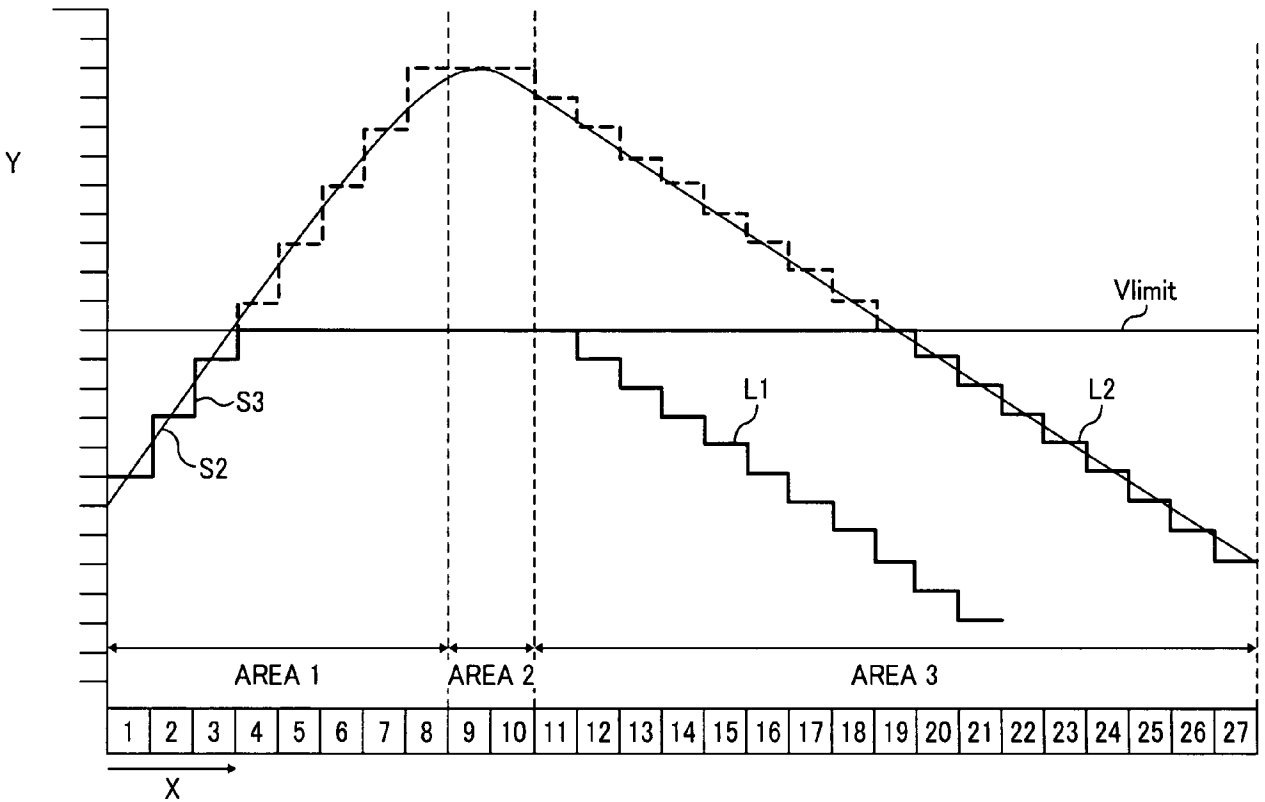
FIG. 7A is example shading correction data stored in the MFP of FIG. 1.
FIG. 7B is an illustration for explaining operation of correcting the light level of the light beam to be emitted by the light source of the optical writing unit of FIG. 3, performed by the image writing controller of FIG. 2, while taking account an upper limit value that is convertible from digital to analog.

As illustrated in FIG. 6B or 7B, the initial light level correction value is changed according to the light level change information as the light beam changes its position in the main scanning direction of the image writing area. Using this light level change information, the shading correction curve is easily obtained even when there is a plurality of divided areas in the image writing area, without the need for storing a plurality of initial light level correction values respectively prepared for the plurality of divided areas.

The shading correction data, which is stored in the correction curve storage unit 1320, may be set or modified at any desired time, for example, through the user interface such as the operation panel 508. For example, the initial light level correction value may be set or modified at any desired time such as at the time of shipping the MFP 1. In this example, the correction curve storage unit 1320 stores the shading correction data, which is obtained by differentiating the shading data obtained using the optical scanning system of the optical writing unit 230.

Referring back to FIG. 4, the DAC controller 1311 generates a DAC control signal S3, which is used to control generation of the light level control signal S2. The DAC controller 1311 includes a DAC control signal value calculator (signal value calculator) 1341, provided with a counter 1343, and a comparator 1342.

The DAC controller 1311 generates a light beam clock signal based on an image pixel clock signal that is generated by an oscillator or synthesizer, which is made in synchronization with the synchronization detection signal DETP received from the synchronization detection sensor 239. The DAC controller 1311 further generates an image writing start signal based on the synchronization detection signal DETP, which is made in synchronization with the image pixel clock signal. The light beam clock signal and the image writing start signal are each input to the counter 1343 of the DAC controller 1311. The counter 1343 is provided to determine the position of the light beam in the main scanning direction. More specifically, the counter value of the counter 1343 is reset as the image writing start signal is input to the counter 1343. After being reset, the counter 1343 increments the counter value by one according to the light beam clock signal. Based on the counter value, the position in the image writing area at which the light beam is irradiated is determined.

Further, in this example, when the synchronization detection signal DETP is input to the DAC controller 1311 to start image writing operation for one line of the image data, the DAC controller 1311 starts operation of controlling a light level of the light beam to be irradiated using the signal value calculator 1341 to form one line of the latent image. More specifically, at the time of starting image writing operation for one line of the image data, the signal value calculator 1341 of the DAC controller 1311 reads the shading correction data from the correction curve storage unit 1320, and determines the start level of the DAC control signal S3 based on the initial light level correction value of the shading correction data for output to the DA converter 1312. The signal value calculator 1341 of the DAC controller 1311 further obtains the light level change information such as information regarding the number of unit areas included in a current divided area of the image writing area to which shading correction is currently applied, the inclination amount to be applied to the current divided area of the image writing area, and the inclination direction to be applied to the current divided area of the image writing area, from the correction curve storage unit 1320. Using the light level change information obtained for the current divided area from the correction curve storage unit 1320, the signal value calculator 1341 calculates a light level correction value for each unit area of the current divided area.

For example, for the first divided area, the signal value calculator 1341 determines an inclination value based on the inclination amount and the inclination direction obtained for the first divided area. The signal value calculator 1341 calculates a light level correction value for the first unit of the first divided area by adding or subtracting the inclination value for the first divided area to or from the initial light level correction value. For the following unit area of the first divided area, the signal value calculator 1341 calculates a light level correction value by adding or subtracting the inclination value for the first divided area to or from the light level correction value obtained for the preceding unit area.

For the second divided area, the signal value calculator 1341 determines an inclination value based on the inclination amount and the inclination direction obtained for the second divided area. The signal value calculator 1341 calculates a light level correction value for each unit of the second divided area by adding or subtracting to or from the light level correction value obtained for the preceding unit area. This operation of calculating the light level correction value is repeated for all unit areas of the image writing area. In this example, the unit area of the image writing area indicates the position of the light beam in the main scanning direction, which is determined based on the counter value of the counter 1343.

The DAC controller 1311 generates the DAC control signal S3 indicating the light level correction value for a current unit area, which is calculated by the signal value calculator 1341, and outputs the DAC control signal S3 in a digital format to the DA converter 1312.

The DA converter 1312 functions as a digital-analog converter. The DA converter 1312 converts the DAC control signal S3 received from the DAC controller 1311 from digital to analog to generate the light level control signal S2 in the analog format, and outputs the light level control signal S2 to the light source controller 1500 through the low pass filter 1400.

The light source controller 1500 controls the on or off of the LD array 231 of the optical writing unit 230 based on the light on/off control signal S1 input from the writing controller 1300. The light source controller 1500 controls the light level of the light beam to be emitted by the LD array 231 based on the light level control signal S2 input from the writing controller 1300 through the low pass filter 1400.

With this simple structure, the light level of the light beam emitted by the light source is controlled such that the light beam is made uniform in the main scanning direction when it reaches the surface of the photoconductor 211, thus improving the image quality of the latent image. Since the shading correction data includes the light level change information indicating how much degree the light level correction value should be changed with respect to the initial light level correction value or the preceding light level correction value obtained for the preceding unit area, a memory space for storing the shading correction data is suppressed, thus reducing the overall cost of the optical writing unit 230 or the MFP 1. Further, since the value of the DAC control signal S3 is obtained based on the initial light level correction value or the preceding light level correction value that is obtained for the preceding unit area, the value of the DAC control signal S3 is calculated relatively easily with improved processing speed.

At the time of forming an image, the writing controller 1300 outputs the light on/off signal S1 to the light source controller 1500 to cause the light source controller 1500 to control the on or off of the LD array 231 of the optical writing unit 230 according to the light on/off signal S1.

Figure 5A:
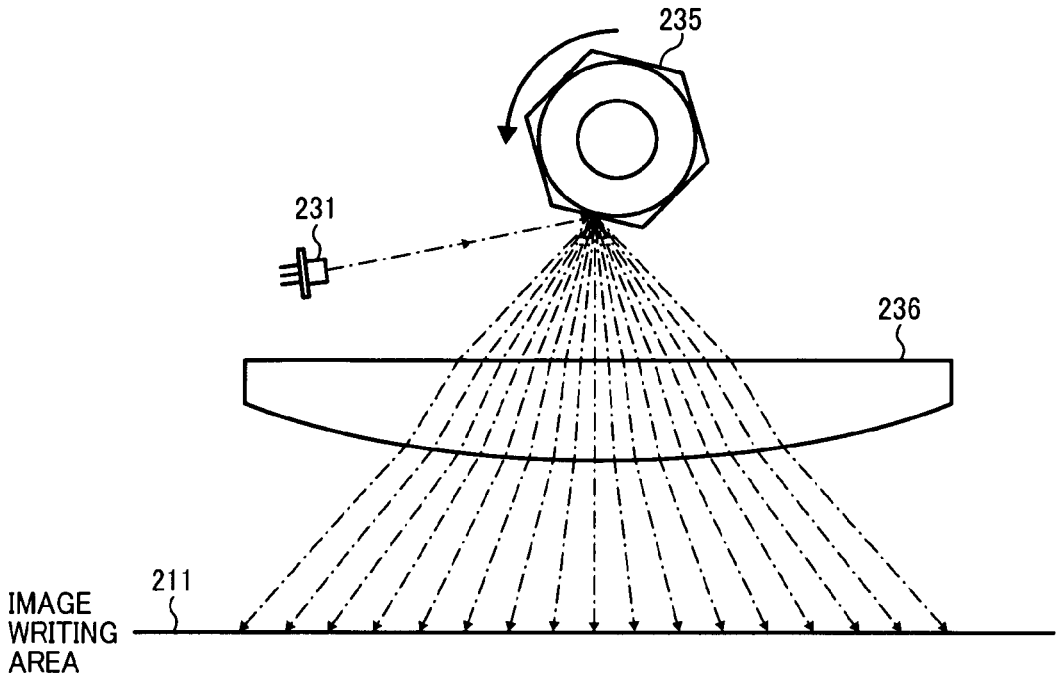
FIG. 5A is an illustration for explaining the path of a light beam emitted by a light source of the optical writing unit of FIG. 3 onto a surface of a photoconductor of the MFP of FIG. 1.

As illustrated in FIGS. 3 and 5A, in the optical writing unit 230, the light beam emitted from the LD array 231 passes through the collimator lens 232, the aperture 233, and the cylindrical lens 234 and enters the polygon mirror 235. The polygon mirror 235, which is rotated at the high rotational speed, causes the light beam to scan through an optical scanning system such as the f-theta lens 236 and the deflective mirror 237 toward the surface of the photoconductor 211. The light beam also enters the synchronization detection sensor 239.

Figure 5B:
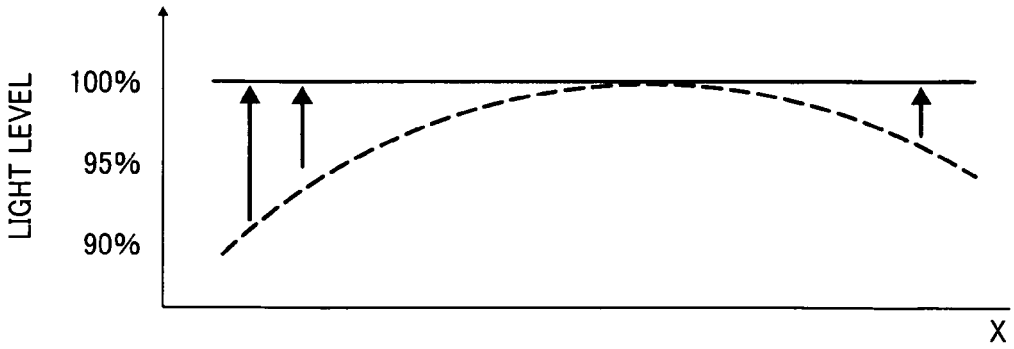
FIG. 5B is an illustration for explaining the light level of the light beam that reaches the surface of the photoconductor of the MFP of FIG. 1, which varies based on the position of the light beam in the main scanning direction.

As indicated by the dashed line illustrated in FIG. 5B, if the light level of the light beam is not corrected based on the shading correction data, the light level or the light exposure power of the light beam emitted onto the surface of the photoconductor 211, which should be uniform throughout the main scanning direction, changes as the light beam moves in the main scanning direction due to the shading characteristics of the optical scanning system such as the f-theta lens 236. As illustrated in FIG. 5A, the polygon mirror 235 irradiates the light beam, which is uniform in light level, onto the surface of the photoconductor 211 in the main scanning direction through the f-theta lens 236. Due to the shading characteristics of the f-theta lens 236, the light level, or the exposure level, of the light beam that reaches the surface of the photoconductor 211 is not uniform as indicated by the dashed line of FIG. 5B.

As described above referring to FIGS. 4, 6A and 6B, the correction curve storage unit 1320 stores the shading correction data to be used for correcting the variance in light level of the light beam. The light level controller 1310 generates the DAC control signal S3 having a light level correction value calculated using the shading correction data obtained from the correction curve storage unit 1320, and causes the DA converter 1312 to output the light level control signal S2 generated based on the DAC control signal S2 to the light source controller 1500 through the low pass filter 1400. The light source controller 1500 controls the LD array 231 so as to emit the light beam having a light level determined based on the light level control signal S2. Further, in this example, as illustrated in FIG. 6A or 7A, the shading correction data includes the light level change information indicating the change in light level correction value relative to the initial light level correction value or the preceding light level correction value obtained for the preceding unit area. When compared to the case in which the light level correction value of the shading correction data is stored for each unit or divided area of the image writing area, a memory space that is required for storing the shading correction data is made less.

More specifically, when the DAC controller 1311 of the light level controller 1310 receives the synchronization detection signal DETP from the synchronization detection sensor 239, the signal value calculator 1341 of the DAC controller 1311 reads the shading correction data out from the correction curve storage unit 1320. Based on the shading correction data, the DAC controller 1311 generates a DAC control signal S3 having a value determined based on the initial light level correction value. Further, the signal value calculator 1341 of the DAC controller 1311 calculates a light level correction value by adding or subtracting an inclination value determined based on the light level change information of the shading correction data to or from the light level correction value obtained for the preceding unit area. The DAC controller 1311 outputs the DAC control signal S3 having the light level correction value calculated by the signal value calculator 1341 to the DA converter 1312. The DA converter 1312 converts the DAC control signal S3 from digital to analog, and outputs the light level control signal S2 through the low pass filter 1400 to the light source controller 1500. The light source controller 1500 controls the light level of the light beam to be emitted by the LD array 231 of the optical writing unit 230 according to the light level control signal S2.

Assuming that the shading correction data of FIG. 6A is stored, after the initial light level correction value is obtained for output, the signal value calculator 1341 of the DAC controller 1311 obtains the light level change information of the shading correction data for the first divided area 1 of the image writing area to perform shading correction on the first divided area 1. More specifically, the DAC controller 1311 obtains the value "2" for the number of unit areas, the value "0" for the inclination amount, and the value "0" for the inclination direction. Based on these values of the shading correction data, the signal value calculator 1341 of the DAC controller 1311 calculates an inclination value for each unit area of the divided area 1 of the image writing area. In this example, the inclination value of "0" is obtained, indicating that no change is required with respect to the initial light level correction value. Based on the inclination value of "0", the signal value calculator 1341 determines the light level correction value to be equal to the initial light level correction value. The DAC controller 1311 outputs the DAC control signal S3 having the light level correction value that is equal to the initial light level correction value, as indicated by the solid line for the divided area 1 in FIG. 6B. Referring to FIG. 6B, the X axis indicates the position of the light beam in the image writing area in the main scanning direction X, which is determined based on the count value of the counter 1343. When the counter value is incremented by one, it is determined that the position of the light beam in the main scanning direction is moved by one unit area. The Y axis of FIG. 6B illustrates the value of the DAC control signal S3, which indicates the light level correction value calculated by the signal value calculator 1341 according to the light level change information and varies as the light beam moves in the main scanning direction X.

When the counter value of the counter 1343 indicates that the accumulated number of unit areas for the divided area 1 reaches the value "2", the DAC controller 1311 obtains the shading correction data for the second divided area 2 of the image writing area to perform shading correction on the second divided area 2. More specifically, the DAC controller 1311 obtains the value "4" for the number of unit areas, the value "3" for the inclination amount, and the value "0" for the inclination direction. Based on these values of the shading correction data, the signal value calculator 1341 of the DAC controller 1311 calculates an inclination value for each unit area of the divided area 2 of the image writing area. In this example, the inclination value of "−3" is obtained, indicating that the light level correction value should be decreased by the value 3 with respect to the light level correction value obtained for the preceding unit area. The DAC controller 1311 outputs the DAC control signal S3 having the light level correction value, which is obtained by subtracting the value 3 from the light level correction value obtained for the preceding unit area, as indicated by the solid line for the divided area 2 in FIG. 6B.

When the counter value of the counter 1343 indicates that the accumulated number of unit areas for the divided area 2 reaches the value "4", the DAC controller 1311 obtains the shading correction data for the third divided area 3 of the image writing area to perform shading correction on the third divided area 3. More specifically, the DAC controller 1311 obtains the value "8" for the number of unit areas, the value "1" for the inclination amount, and the value "0" for the inclination direction. Based on these values of the shading correction data, the signal value calculator 1341 of the DAC controller 1311 calculates an inclination value for each unit area of the divided area 3 of the image writing area. In this example, the inclination value of "−1" is obtained, indicating that the light level correction value should be decreased by the value 1 with respect to the light level correction value obtained for the preceding unit area. The DAC controller 1311 outputs the DAC control signal S3 having the light level correction value, which is obtained by subtracting the value 1 from the light level correction value obtained for the preceding unit area, as indicated by the solid line for the divided area 3 in FIG. 6B.

When the counter value of the counter 1343 indicates that the accumulated number of unit areas for the divided area 3 reaches the value "8", the DAC controller 1311 obtains the shading correction data for the fourth divided area 4 of the image writing area to perform shading correction on the fourth divided area 4. More specifically, the DAC controller 1311 obtains the value "12" for the number of unit areas, the value "2" for the inclination amount, and the value "1" for the inclination direction. Based on these values of the shading correction data, the signal value calculator 1341 of the DAC controller 1311 calculates an inclination value of the DAC control signal S3 for each unit area of the divided area 4 of the image writing area. In this example, the inclination value of "+2" is obtained, indicating that the light level correction value should be increased by the value 2 with respect to the light level correction value obtained for the preceding unit area. The DAC controller 1311 outputs the DAC control signal S3 having the light level correction value, which is obtained by adding the value 2 to the light level correction value obtained for the preceding unit area, as indicated by the solid line for the divided area 4 in FIG. 6B. In this manner, the light level of the light beam to be emitted by the light source is made uniform throughout the main scanning direction as indicated by the solid line of FIG. 5B. The above-described shading correction is performed repeatedly for each line of the image data as the synchronization detection signal DETP is detected from the synchronization detection sensor 239.

In the above-described case, the value of the DAC control signal S3 calculated by the signal value calculator 1341 may exceed an upper limit value Vlimit that is convertible by the DA converter 1312. For example, as illustrated in FIG. 7B, the value of the DAC control signal S3 calculated by the DAC controller 1311 may continue to exceed the upper limit value Vlimit that is convertible by the DA converter 1312 as the light beam moves in the main scanning direction X, as indicated by the dashed line. In such case, the DAC controller 1311 continues to output the light value control signal S3 having the upper limit value Vlimit as indicated by the bold solid line of FIG. 7B, as long as the light level change information indicates that the light level correction value should increase or remain unchanged.

More specifically, as illustrated in FIG. 4, the DAC controller 1311 is provided with the comparator 1342, which compares the calculated light level correction value obtained by the signal value calculator 1341 with the upper limit value Vlimit before outputting the DAC control signal S3. When the comparison result indicates that the calculated value is equal to or less than the upper limit value Vlimit, the DAC controller 1311 outputs the DAC control signal S3 having the calculated value. When the comparison result indicates that the calculated value exceeds the upper limit value Vlimit, the DAC controller 1311 outputs the upper limit value Vlimit.

With the above-described structure, as illustrated in FIG. 7B, the value of the DAC control signal S3 is kept at the upper limit value Vlimit as long as the inclination direction and/or the inclination amount of the shading correction data indicates that the light level correction value should increase or remain unchanged with respect to the light level correction value obtained for the preceding unit area. This is because the signal value calculator 1341 calculates the light level correction value for the current unit area based on the light level correction value obtained for the preceding unit area. When the inclination direction and/or the inclination amount of the shading correction data indicates that the light level correction value should decrease as the light beam enters the divided area 3, the light level correction value calculated by the signal value calculator 1341 will be less than the upper limit value Vlimit. However, if the light level correction value is calculated by subtracting the inclination value of "1" from the light level correction value for the preceding unit area, which is equal to the upper limit value Vlimit, the DAC control signal S3 will have a light level correction value much lower than the accurate light level correction value indicated by the dashed line. Accordingly, the position at which the light level should start decreasing is shifted upstream in the main scanning direction, thus the value of the DAC control signal S3 is not accurate as indicated by L1 of FIG. 7B.

In order to solve this problem, the signal value calculator 1341 continues to calculate a light level correction value and retain the calculated light level correction value, for example, in a memory provided in the DAC controller 1311. With this structure, even when the light level correction value of the DAC control signal S3 exceeds the upper limit value Vlimit that is convertible by the DA converter 1312, the signal value calculator 1341 is able to accurately obtain the light level correction value for the current unit area based on the light level correction value for the preceding unit area, which is retained. More specifically, when the calculated light level correction value exceeds the upper limit value Vlimit that is convertible by the DA converter 1312, the DAC controller 1311 outputs the DAC control signal S3 having the upper limit value Vlimit to the DA converter 1312 for conversion, while still calculating the light level correction value using the light level change information. The calculated light level correction value is retained as the light level correction value obtained for the preceding unit area. When it is determined that the light level correction value will be lower than the upper limit value Vlimit, the DAC controller 1311 outputs the DAC control signal S3 having a value calculated using the light level correction value obtained for the preceding unit area. In this manner, the DAC control signal S3 having the correct light level correction value is obtained as indicated by L2 of FIG. 7B. In this example, the DAC controller 1311 may determine that the light level correction value will be lower than the upper limit value Vlimit when the inclination value indicates that the light level correction value should decrease. In such case, the comparator 1342 does not have to perform comparison after the comparison result indicates that the calculated value of the signal value calculator 1341 exceeds the upper limit value Vlimit, until the DAC controller 1311 determines that the light level correction value will be lower than the upper limit value Vlimit based on the inclination value.

With this structure of the writing controller 1300, the light level of the light beam to be emitted from the LD array 231 in the main scanning direction is corrected to be uniform in the main scanning direction of the image writing area. As described above, when the synchronization detection signal DETP for each line of the image data is detected, the DAC controller 1311 of the light level controller 1310 reads out the shading correction data from the correction curve storage unit 1320, and generates the DAC control signal S3 having the light level correction value calculated based on the shading correction data. The DA converter 1312 converts the DAC control signal S3 from digital to analog to generate and output the light level control signal S2. The light source controller 1500 controls the light level of the light beam to be emitted by the LD array 231 based on the light level control signal S2. In this manner, the light level of the light beam emitted from the LD array 231 is corrected to be uniform in the main scanning direction, thus achieving improved image quality with a simple structure.

Further, since the shading correction data is stored in the relative value with respect to the value obtained for the preceding unit area as the light level change information, the memory space requirement is suppressed such that the MFP 1 does not have to be provided with a large amount of memory space even when the number of divided areas increases. For instance, the specific value of the light level correction value does not have to be provided and stored for each divided area of the image writing area, which requires a large amount of memory space. Since the memory space requirement is made less, the number of divided areas of the image writing area may increase to improve the reproducibility of the shading characteristics, thus improving the image quality. With this structure, the MFP 1 is able to achieve high image quality while suppressing the overall manufacturing cost.

Further, in this example, the DAC controller 1311 continues to calculate the light level correction value based on the shading correction data and retains the calculated value even when the light level correction value exceeds the upper limit value Vlimit convertible by the DA converter 1312, while outputting the DAC control signal S3 having the upper limit value Vlimit to the DA converter 1312.

Further, in this example, the shading correction data stored in the correction curve storage unit 1320 may be set or modified at any desired time through the user interface such as the operation panel 508 of the MFP 1. With this function, the MFP 1 is made applicable to various types of the optical writing unit 230, or various types of f-theta lens 236 having different shading characteristics. Further, with this function, the MFP 1 is maintained relatively easily by allowing the service personnel to set or modify the initial light level correction value through the operation panel 508 of the MFP 1 to adjust the change in the shading correction values attributable to the degradation of the optical writing unit 230. For example, due to the degradation of photoconductor 211, the service personnel may need to adjust the image intensity by changing the shading correction value which differs among the divided areas of the image writing area. Even in such case, the service personnel needs to only modify the initial light level correction value no matter how many divided areas are defined. Accordingly, maintenance of the MFP 1 is made easier even when there is a plurality of divided areas of the image writing area.

Further, in this example, the shading correction data stored in the correction curve storage unit 1320 is obtained by differentiating the shading data obtained from the scanning system of the optical writing unit 230. In this manner, the accuracy of the shading correction data improves, thus improving the image quality.

Referring now to FIGS. 8 to 12, a structure of a light level controller 1330 is explained according to an example embodiment of the present invention. In this example, it is assumed that the light level controller 1330 is provided in the writing controller 1300 of FIG. 2 in place of the light level controller 1310 of FIG. 4. Further, in this example, as illustrated in FIG. 10A, the optical writing unit 230 is additionally provided with a face detection sensor 2001 capable of outputting a face detection signal.

Figure 8:
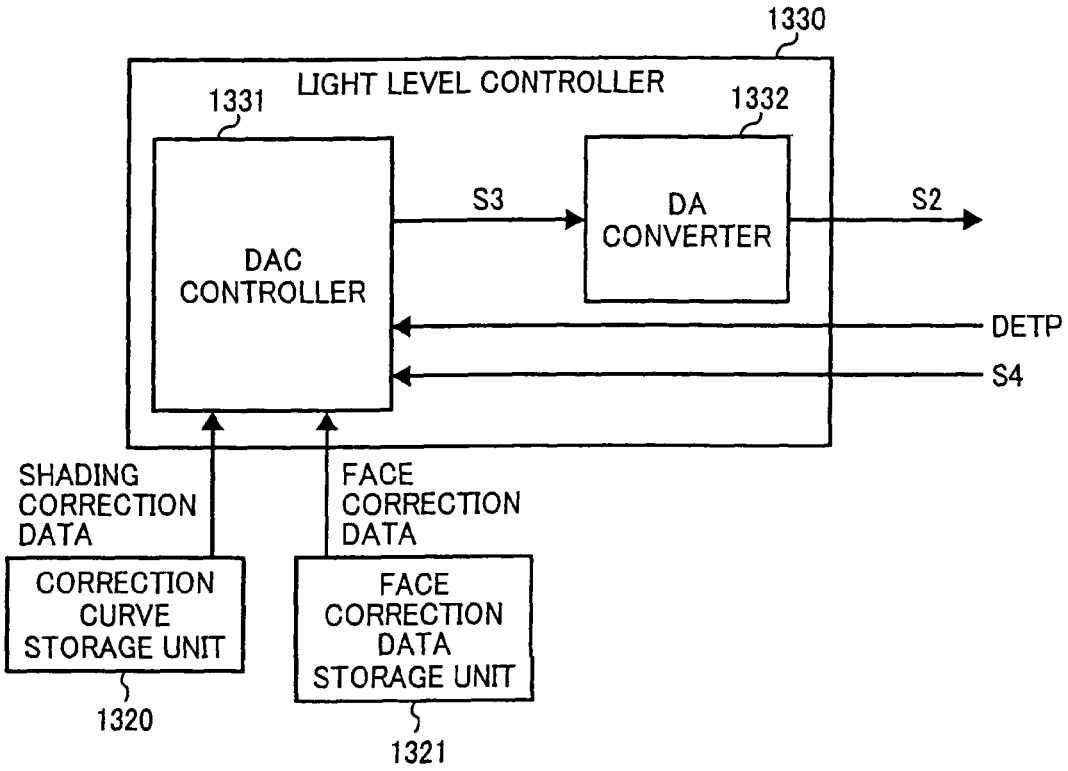
FIG. 8 is a schematic block diagram illustrating a light level controller included in the image writing controller of FIG. 2.

Referring to FIG. 8, the light level controller 1330 includes a DAC controller 1331 and a DA converter 1332. The DAC controller 1331 is substantially similar in function and structure to the DAC controller 1311 of FIG. 4. The DA converter 1332 is substantially similar in function and structure to the DA converter 1312 of FIG. 4. The DAC controller 1331 is connected to the correction curve storage unit 1320 and a face correction data storage unit 1321.

Figure 9:
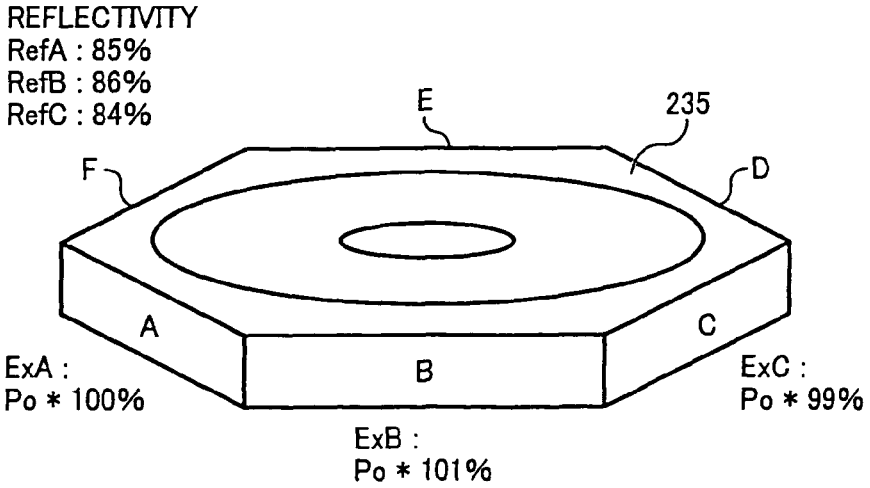
FIG. 9 is an illustration for explaining the reflectivity of a polygon mirror of the optical writing unit of FIG. 3 for each surface of the polygon mirror.

The face correction data storage unit 1321 stores the initial light level correction value for each one of a plurality of surfaces of the polygon mirror 235 as face correction data. As illustrated in FIG. 9, in this example, the polygon mirror 235 has six surfaces including the surfaces A, B, C, D, E, and F. Thus, the face correction data storage unit 1321 stores the initial light level correction value for each of the surfaces A to F as the face correction data. Alternatively, the face correction data may be expressed as the relative initial light level correction value, which indicates the difference between the initial light level correction value for a specific surface and the initial light level correction value for a reference surface. For example, the initial light level correction value for any one of the surfaces B to F may be expressed in a relative value with respect to the initial light level correction value for the reference surface A. The shading correction data stored in the correction curve storage unit 1320 and the face correction data stored in the face correction data storage unit 1321 may be set or modified at any desired time through the user interface such as the operation panel 508 of the MFP 1. For example, the initial light level correction value stored in the correction curve storage unit 1320 may be set or modified at any desired time such as at the time of shipping the MFP 1.

Further, the initial light level stored in the correction curve storage unit 1320 may be set or modified using software such as the image writing control program stored in a desired memory of the MFP 1. In one example, the initial light level correction value stored in the correction curve storage unit 1320 may be set or modified for each line of the image data using the face correction data stored in the face correction data storage unit 1321, at the time when it is determined that the line of the image data is changed based on the synchronization detection signal DETP and a face detection signal S4.

The DAC controller 1331 receives the synchronization detection signal DETP from the synchronization detection sensor 239, and the face detection signal S4 from the face detection sensor 2001.

Figure 10A:
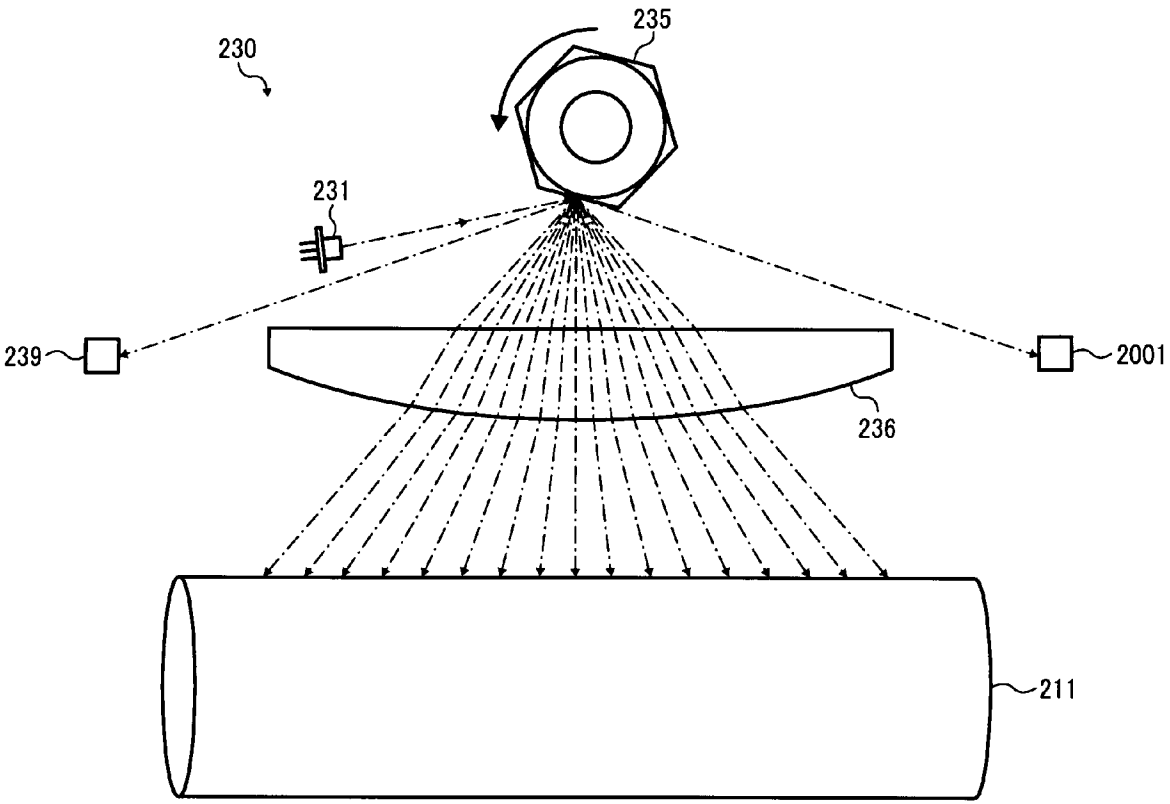
FIG. 10A is an illustration for explaining the path of a light beam emitted by the light source of the optical writing unit of FIG. 3 onto the surface of the photoconductor of the MFP of FIG. 1, when the optical writing unit of FIG. 3 is additionally provided with a face detection sensor.
Figure 10B:
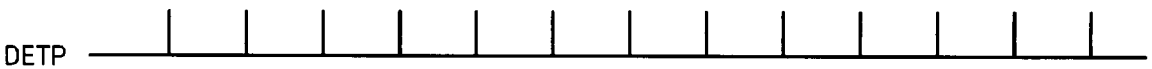
FIG. 10B is a timing chart illustrating a synchronization detection signal output by a synchronization detection sensor of the optical writing unit of FIG. 10A.
Figure 10C:
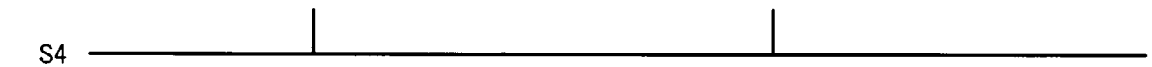
FIG. 10C is a timing chart illustrating a face detection signal output by the face detection sensor of the optical writing unit of FIG. 10A.

As illustrated in FIG. 10A, the synchronization detection sensor 239 and the face detection sensor 2001 of the optical writing unit 230 are each provided outside the image writing area in the main scanning direction. The face detection sensor 2001 detects the light beam emitted by the LD array 231, and outputs the face detection signal S4 to the writing controller 1300. The face detection signal S4 output by the face detection sensor 2001 is used to determine the surface of the polygon mirror 235 that currently deflects the light beam. As illustrated in FIGS. 10B and 10C, the face detection signal S4 is output right before the synchronization detection signal DETP for the reference surface A of the polygon mirror 235 is output. Alternatively, the face detection signal S4 may be output right before the synchronization detection signal DETP for the surface of the polygon mirror 235 other than the reference surface A is output.

Figure 11A:
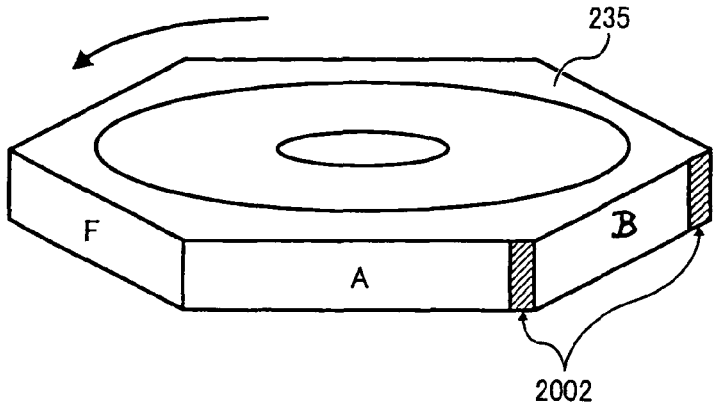
FIG. 11A is a perspective view illustrating a reflection prevention member, which may be provided on a surface of the polygon mirror of the optical writing unit of FIG. 10A.

As illustrated in FIG. 11A, the polygon mirror 235 may be provided with a reflection prevention member 2002 respectively at the surfaces A to E except for the surface F that is arranged right before the reference surface A in the mirror rotation direction indicated by the arrow. The reflection prevention member 2002 is provided at a specific location of each surface such that the light beam irradiated to the reflection prevention member 2002 is prevented from being deflected toward the face detection sensor 2001. With this structure, the light beam irradiated to the surface F in which the reflection prevention member 2002 is not provided is deflected toward the face detection sensor 2001. As illustrated in FIG. 10B, the face detection signal S4 is output right before the reference surface A of the polygon mirror 235 receives the light beam. The face detection signal S4 is output to the DAC controller 1331 of the light level controller 1330.

Figure 11B:
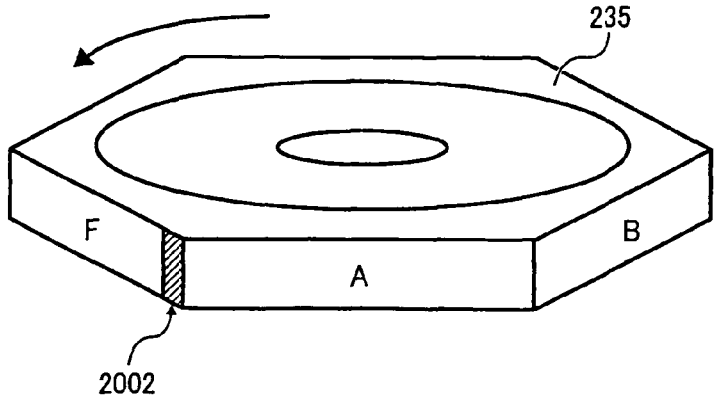
FIG. 11B is a perspective view illustrating a reflection prevention member, which may be provided on a surface of the polygon mirror of the optical writing unit of FIG. 10A.

Alternatively, as illustrated in FIG. 11B, the reflection prevention member 2002 may be provided at the surface F that is arranged right before the reference surface A in the mirror rotation direction indicated by the arrow. In such case, the light beam irradiated to the surfaces A to E in which the reflection prevention member 2002 is not provided is deflected toward the face detection sensor 2001. With this structure illustrated in FIG. 11B, the face detection signal S4 is output right before the synchronization detection signal DETP for the surface of the polygon mirror 235 other than the reference surface A is output.

Figure 11C:
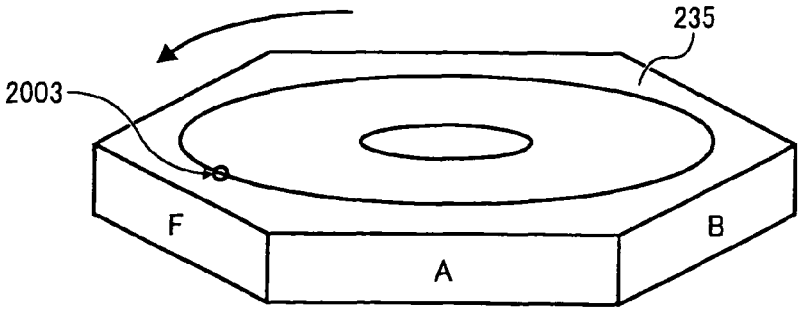
FIG. 11C is a perspective view illustrating a reference selection mark, which may be provided on a surface of the polygon mirror of the optical writing unit of FIG. 10A.

The reference surface A may be detected in various other ways other than providing the reflection prevention member 2002 at the surface of the polygon mirror 235. For example, as illustrated in FIG. 11C, a reference surface selection mark 2003 may be provided at the surface F that is arranged right before the reference surface A in the mirror rotation direction indicated by the arrow. The reference surface selection mark 2003 reflects the light beam toward the face detection sensor 2001 to cause the face detection signal S4 to output before the surface A of the polygon mirror 235 receives the light beam.

When the synchronization detection signal DETP enters, the DAC controller 1331 reads the shading correction data out from the correction curve storage unit 1320. Based on the detection result of the face detection signal S4, the DAC controller 1331 determines whether the surface of the polygon mirror 235 that will receive the light beam after the synchronization detection signal DETP is detected (or the surface of the polygon mirror 235 that corresponds to the detected synchronization detection signal DETP) is the reference surface A or the other surface. When it is determined that the surface of the polygon mirror 235 that corresponds to the detected synchronization detection signal DETP is not the reference surface A, the DAC controller 1331 further specifies one of the surfaces B to F, for example, by counting the number of synchronization detection signals DETP that have been detected since the synchronization detection signal DETP that corresponds to the reference surface A is detected. Once the surface of the polygon mirror 235 is specified, the DAC controller 1331 reads the face correction data that corresponds to the specified surface from the face correction data storage unit 1321. Using the face correction data, the DAC controller 1331 corrects the shading correction data obtained from the correction curve storage unit 1320. The DAC controller 1331 generates a DAC control signal S3 in the digital format based on the corrected shading correction data. More specifically, in this example, the DAC controller 1331 determines the initial light level correction value based on the specified surface of the polygon mirror 235 using the face correction data and/or the shading correction data. The DAC controller 1331 determines an inclination value for each divided area based on the light level change information obtained from the correction curve storage unit 1320 in a substantially similar manner as described above referring to FIGS. 1 to 7. The DAC controller 1331 then calculates a light level correction value by adding or subtracting the inclination value to or from the initial light level correction value obtained for the specific mirror surface. The DAC controller 1331 generates the DAC control signal S3 having the calculated light level correction value. The DAC control signal S3 is output to the DA converter 1332 in the digital format.

The DA converter 1332 converts the DAC control signal S3 from digital to analog to generate the light level control signal S2 in the analog format, and outputs the light level control signal S2 through the low pass filter 1400 to the light source controller 1500.

In this example, since the light level correction value is determined differently among the different mirror surfaces of the polygon mirror 235, the light level of the light beam is controlled to be uniform among the different mirror surfaces of the polygon mirror 235.

Figure 12A:
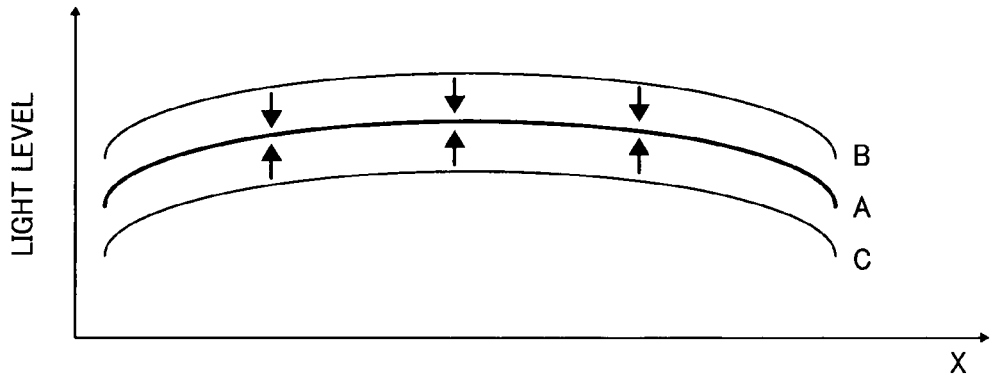
FIG. 12A is an illustration for explaining the light level of the light beam that reaches the surface of the photoconductor of the MFP of FIG. 1, which varies based on the position of the light beam in the main scanning direction and the surface of the polygon mirror that reflects the light beam.
Figure 12B:
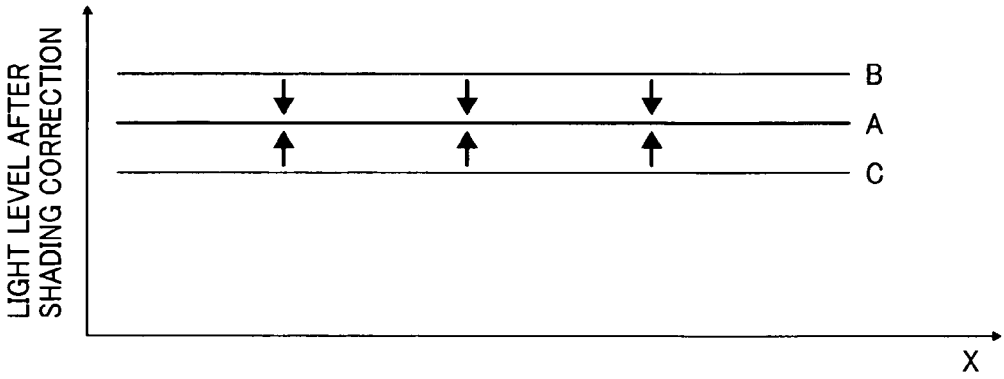
FIG. 12B is an illustration for explaining the light level of the light beam that reaches the surface of the photoconductor of the MFP of FIG. 1 after applying shading correction, which varies based on the surface of the polygon mirror that reflects the light beam.

When the reflectivity of the polygon mirror 235 varies among a plurality of surfaces of the polygon mirror 235 of the optical writing unit 230, the light level of the light beam that is reflected by the polygon mirror 235 will be different among the plurality of surface of the polygon mirror 235. For example, as illustrated in FIG. 9, it is assumed the reflectivity of the surface A, surface B, and surface C are 85%, 86%, and 84%, respectively. If the surface A is the reference surface having the relative reflectivity of 100%, the light level ExA of the laser beam to be reflected by the surface A is expressed as Po*100%, with the Po being the light level of the laser beam to be reflected by the surface A. The light level ExB of the laser beam to be reflected by the surface B is expressed as Po*101%. The light level ExC of the laser beam to be reflected by the surface C is expressed as Po*99%. Since the reflectivity differs among the surfaces A, B, and C, the light level of the laser beam that reaches the surface of the photoconductor 211 through the f-theta lens 236 will be different among the surfaces A, B, and C, as illustrated in FIGS. 12A and 12B. FIG. 12A indicates the light level of the light beam that reaches the surface of the photoconductor 211, which is obtained while not performing shading correction using the light level controller 1310 or 1330. FIG. 12B indicates the light level of the light beam that reaches the surface of the photoconductor 211, which is obtained while performing shading correction using the light level controller 1310. Referring to FIGS. 12A and 12B, the X axis indicates the position of the light beam in the main scanning direction, and the Y axis indicates the light level of the light beam that reaches the surface of the photoconductor 211. Referring to FIG. 12B, even with shading correction, the light level of the light beam that reaches the surface of the photoconductor 211 may not be made uniform among the different surfaces as the reflectivity varies among the different surfaces.

In such case, the service personnel may adjust the light level of the light beam to be emitted in the sub-scanning direction in order to improve the image quality. However, such further adjustment has been cumbersome.

In view of the above, as illustrated in FIGS. 8 and 10A, the optical writing unit 230 is provided with a detector capable of detecting the specific surface of the polygon mirror 235, such as the reflection prevention member 2002 or the reference surface selection mark 2003, and the face detection sensor 2001. In one example, as described above referring to FIGS. 11A and 11C, the face detection sensor 2001 outputs the face detection signal S4 indicating the time when the polygon mirror 235 changes the surface for deflecting the light beam from the surface other than the reference surface to the reference surface. In another example, as described above referring to FIG. 11B, the face detection sensor 2001 outputs the face detection signal S4 indicating the time when the polygon mirror 235 changes the surface for deflecting the light beam from one surface other than the reference surface to another surface other than the reference surface. When the DAC controller 1331 detects the face detection signal S4, the DAC controller 1331 determines which surface of the polygon mirror 235 reflects the light beam based on the face detection signal S4, or based on the face detection signal S4 and the synchronization detection signal DETP.

Once the surface for deflecting the light beam is determined, the DAC controller 1331 obtains the face correction data that corresponds to the determined surface of the polygon mirror 235 from the face correction data storage unit 1321. Using the obtained face correction data, the DAC controller 1331 corrects the shading correction data obtained from the correction curve storage unit 1320, for example, by adding or subtracting a predetermined value to or from the shading correction data. For example, the face correction data storage unit 1321 may store the face correction data indicating the relative initial light level correction value for each surface with respect to the initial light level correction value obtained for the reference surface, each of which may be determined based on the relative reflectivity for each surface with respect to the reflectivity obtained for the reference surface. Such face correction data stored in the face correction data storage unit 1321 may be referred to as the relative face correction value.

The DAC controller 1331 calculates a light level correction value based on the corrected shading correction data. For example, the DAC controller 1331 calculates a light level correction value for each unit area by adding or subtracting the inclination value determined based on the light level change information to or from the corrected initial light level obtained for the specific mirror surface. The DAC controller 1331 further outputs the DAC control signal S3 having the calculated value to the DA converter 1332 in the digital format. The DA converter 1332 converts the DAC control signal S3 from digital to analog to generate the light level control signal S2, and outputs the light level control signal S2 through the low pass filter 1400 to the light source controller 1500.

As described above, the MFP 1 is provided with the face correction data storage unit 1321, which stores the face correction data indicating the relative face correction value for each one of the surfaces of the polygon mirror 235 with respect to the reference surface of the polygon mirror 235. With the face correction data, the shading correction data obtained from the correction curve storage unit 1320 is adjusted such that the light level of the light beam to be emitted from the LD array 231 is made uniform among the different surfaces of the polygon mirror 235 even when the reflectivity differs among the different surfaces of the polygon mirror 235. More specifically, as illustrated in FIGS. 12A and 12B, the light level of the light beam to be emitted from each surface of the polygon mirror 235 is controlled such that the light level of the light beam that reaches the image writing area is made uniform among the different mirror surfaces of the polygon mirror 235, thus improving the image quality.

Further, in this example, even when the DAC control signal S2 has a value that exceeds the upper limit value Vlimit that is convertible by the DA converter 1332, the DAC controller 1331 continues to calculate the light level correction value of the DAC control signal S3 based on the corrected shading correction data, while outputting the DAC control signal S3 having the upper limit value Vlimit to the DA converter 1332. When the light level change information indicates that the value of the DAC control signal S3 should decrease, the DAC controller 1331 outputs the DAC control signal S3 having the value calculated and retained by the DAC controller 1331 to the DA converter 1332. The DA converter 1332 converts the DAC control signal S3 from digital to analog to generate the light level control signal S2.

Further, in this example, the shading correction data and the face correction data may be each set or modified by the user at any desired time through the user interface such as the operation panel 508 of the MFP 1. With this function, the MFP 1 is made applicable to various types of the optical writing unit 230. For example, the shading correction may be performed differently depending on various types of f-theta lens 236 having different shading characteristics or various types of the polygon mirror 235 having the surfaces with different shading characteristics. Further, with this function, the MFP 1 is maintained relatively easily by allowing the service personnel to set or modify the initial light level correction value through the user interface such as the operation panel 508 of the MFP 1 to adjust the change in the shading correction values attributable to the degradation of the optical writing unit 230.

Further, in this example, the shading correction data stored in the correction curve storage unit 1320 is obtained by differentiating the shading data obtained from the scanning system of the optical writing unit 230. In this manner, the accuracy of the shading correction data improves, thus improving the image quality.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

For example, any one of the optical writing units 230 described above may be incorporated into any desired type of image forming apparatus such as a printer, a copier, a facsimile, etc., each of which is capable of scanning a light beam to an image writing area. Alternatively, any one of the above-described methods of controlling the light level of the light beam to be emitted by the light source may be performed by any desired type of apparatus. Any one of the above-described methods of controlling the light level of the light beam may be implemented as a computer program, which may be stored in any desired recording medium.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, involatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

Further, in the above-described example, the synchronization detection sensor 239 is provided for each color of cyan, magenta, yellow and black. Alternatively, any number of synchronization detection sensor 239 may be provided at any desired location as long as the time for starting image writing operation for each color can be detected.

Further, the shading correction data stored in the correction curve storage unit 1320 or the face correction data stored in the face correction data storage unit 1321 may be set or modified at any desired time through any desired type of interface such as the network interface or the recording medium.

Further, the shading correction data stored in the correction curve storage unit 1320 or the face correction data stored in the face correction data storage unit 1321 may be set or modified automatically depending on an image forming mode of the MFP 1. For example, when the MFP 1 is instructed by the user to form an image at a high image quality mode, the initial light level may be adjusted accordingly.

In one example, the present invention may reside in an image forming apparatus including: light source means for irradiating a light beam used for writing an image; light source controlling means for controlling operation of the light source means based on image data; rotatable deflector means having a plurality of reflective surfaces, with one reflective surface configured to rotate at a predetermined rotational speed to scan the light beam irradiated by the light source means in a main scanning direction; a photoconductor configured to receive the light beam scanned by the reflective surface of the rotatable deflector means to form one line of the image data; synchronization detection means provided outside the image writing area in the main scanning direction for outputting a synchronization detection signal for one line of the image data when the light beam scanned by the rotatable deflector means is detected; correction data storage means for storing light level correction data used for correcting the variance in light level of the light beam emitted and scanned onto the surface of the photoconductor in the main scanning direction; and light level control means for causing the light source control means to correct the light level of the light beam irradiated by the light source means using the light level correction data obtained from the correction data storage means based on the synchronization detection signal.

In the above-described example, the light level correction data stored in the correction data storage means includes an initial correction value to be used for changing a light level in a divided area, the divided area being one of a plurality of divided areas obtained by dividing the image writing area in the main scanning direction. The light level correction data further includes an inclination direction indicating the direction of change in light level, an inclination amount indicating the degree of change in light level, and a number of continuous unit areas each of unit area being applied with the same inclination direction and the same inclination amount.

In the above-described example, the light level control means includes: signal generating means for generating a light level correction signal based on the light level correction data in a digital format; means for converting the light level correction signal from digital to analog; and means for causing the light source controlling means to correct the light level of the light beam emitted by the light source based on the light level correction signal output by the means for converting.

In the above-described example, the signal generating means includes: means for calculating a value of the light level correction signal based on the light level correction data; and means for comparing the value of the light level correction signal with an upper limit value that is convertible by the means for converting. When the value of the light level correction signal calculated by the means for calculating exceeds the upper limit value that is convertible by the means for converting, the signal generating means outputs a light level correction signal having the upper limit value, while causing the means for calculating to continue to calculate the value of the light level correction signal.

In the above-described example, the image forming apparatus may further include: face correction data storage means for storing face correction data used for correcting the light level correction data depending on each surface of the plurality of surfaces of the rotatable deflector means; and face detector means for detecting a surface of the plurality of surfaces of the rotatable deflector means configured to deflect the light beam irradiated by the light source means for a next line of the image data. The light level control means corrects the light level correction data based on the face correction data obtained from the face correction data storage means that matches the surface of the plurality of surfaces of the rotatable deflector means detected by the face detector means.

In the above-described example, the image forming apparatus further includes means for allowing a user to set or modify the light level correction data.

In another example, the present invention may reside in an image forming method including the steps of: controlling operation of a light source means for irradiating a light beam used for writing an image based on image data; causing one of a plurality of reflective surfaces of rotatable deflector means to rotate at a predetermined rotational speed to scan the light beam irradiated by the light source means in a main scanning direction; outputting a synchronization detection signal for one line of the image data when the light beam scanned by the rotatable deflector means is detected using synchronization detection means provided outside the image writing area in the main scanning direction; storing light level correction data used for correcting the variance in light level of the light beam emitted and scanned onto the surface of the photoconductor in the main scanning direction; and controlling light source controlling means to correct the light level of the light beam irradiated by the light source means using the light level correction data based on the synchronization detection signal.

In the above-described example, the light level correction data includes an initial correction value to be used for changing a light level in a divided area, the divided area being one of a plurality of divided areas obtained by dividing the image writing area in the main scanning direction. The light level correction data further includes an inclination direction indicating the direction of change in light level, an inclination amount indicating the degree of change in light level, and a number of continuous unit areas each of unit area being applied with the same inclination direction and the same inclination amount.

In the above-described example, the step of controlling the light source controlling means includes: generating a light level correction signal based on the light level correction data in a digital format; converting the light level correction signal from digital to analog; and causing the light source controlling means to correct the light level of the light beam emitted by the light source based on the light level correction signal output by the step of converting.

In the above-described example, the step of generating includes: calculating a value of the light level correction signal based on the light level correction data; and comparing the value of the light level correction signal with an upper limit value that is convertible by the step of converting. When the value of the light level correction signal calculated by the step of calculating exceeds the upper limit value that is convertible by the step of converting, the step of generating outputs a light level correction signal having the upper limit value, while causing the step of calculating to continue to calculate the value of the light level correction signal.

In the above-described example, the method further includes: storing face correction data used for correcting the light level correction data depending on each surface of the plurality of surfaces of the rotatable deflector means; and detecting a surface of the plurality of surfaces of the rotatable deflector means that deflects the light beam irradiated by the light source means for a next line of the image data. The step of controlling the light source controlling means corrects the light level correction data based on the face correction data that matches the surface of the plurality of surfaces of the rotatable deflector means detected by the step of detecting the surface of the plurality of surface of the rotatable deflector means.

In another example, the present invention may reside in a recording medium storing a computer program that causes an apparatus to perform any one of the above-described methods.

In one example, the present invention may reside in an image forming apparatus including: a light source configured to irradiate a light beam; a rotatable deflector configured to rotate to scan the light beam irradiated by the light source to an image writing area in a main scanning direction to form an image on the image writing area; a detector provided outside the image writing area and configured to output a synchronization detection signal indicating the time when the light beam scanned by the rotatable deflector enters the image writing area; a storage unit configured to store light level correction data; and a light level controller configured to cause the light source to irradiate the light beam having a light level determined based on the light level correction value for the specific main scanning position. The storage unit includes an initial light level correction value indicating an initial light level of the light beam to be irradiated by the light source when the light beam enters the image writing area after the synchronization detection signal is output; and light level change information indicating the change in a light level correction value for a specific main scanning position with respect to the initial light level correction value, the light level correction value for the specific main scanning position indicating a light level of the light beam to be irradiated by the light source when the light beam scans at the specific main scanning position of the image writing area.

In the above-described example, the light level change information of the light level correction data includes: inclination amount data indicating the degree of change in light level correction value with respect to the initial light level correction value or a preceding light level correction value, the preceding light level correction value indicating a light level of the light beam to be irradiated onto a preceding main scanning position of the image writing area that precedes the specific main scanning position; and inclination direction data indicating the direction of change in light level correction value with respect to the initial light level correction value or the preceding light level correction value.

Further, in the above-described example, the light level change information of the light level correction data further includes data indicating a divided area of the image writing area to which the same inclination value is to be applied to calculate the light level correction value for the specific main scanning position.

In the above-described example, the data indicating a divided area of the image writing area to which the same inclination value is to be applied is information indicating the number of continuous unit areas included in the divided area of the image writing area to which the same inclination value is to be applied. In this example, one unit area may be specified using the counter value of a counter that determines the position of the light beam in the main scanning direction.

In the above-described example, the operation of correcting the light level of the light beam to be emitted by the light source is controlled for one line of the image, based on the light level correction data obtained for one lien of the image. For example, when the synchronization detection signal is output to indicate starting of forming one line of the image, the light level correction data for the line of the image to be formed is obtained from the storage unit. The light level of the light beam to be emitted is then corrected based on the light level correction data. This operation may be repeated automatically by the image forming apparatus every time the synchronization detection signal is output to indicate starting of forming one line of the image.

The invention claimed is:

1. A light level controlling apparatus, comprising:

a light source configured to irradiate a light beam;

a rotatable deflector configured to rotate to scan the light beam irradiated by the light source to an image writing area in a main scanning direction to form an image on the image writing area;

a detector provided outside the image writing area and configured to output a synchronization detection signal indicating a time when the light beam scanned by the rotatable deflector enters the image writing area;

a storage unit configured to store light level correction data, the light level correction data including:

an initial light level correction value indicating an initial light level of the light beam to be irradiated by the light source when the light beam enters the image writing area after the synchronization detection signal is output; and light level change information indicating a change in a light level correction value for a specific main scanning position with respect to the initial light level correction value, the light level correction value for the specific main scanning position indicating a light level of the light beam to be irradiated by the light source when the light beam scans at the specific main scanning position of the image writing area; and a light level controller configured to cause the light source to irradiate the light beam having the light level determined based on the light level correction value for the specific main scanning position;

wherein the light level change information of the light level correction data includes:

inclination amount data indicating a degree of change in the light level correction value with respect to the initial light level correction value or a preceding light level correction value, the preceding light level correction value indicating a light level of the light beam to be irradiated onto a preceding main scanning position of the image writing area that precedes the specific main scanning position; and inclination direction data indicating a direction of change in the light level correction value with respect to the initial light level correction value or the preceding light level correction value.

2. The apparatus of claim 1, wherein the light level controller includes:

a signal value calculator configured to obtain an inclination value based on the inclination amount data and the inclination direction data, and to calculate the light level correction value for the specific main scanning position by adding or subtracting the inclination value to or from the initial light level correction value or the preceding light level correction value.

3. The apparatus of claim 2, wherein the light level change information of the light level correction data further includes:

data indicating a divided area of the image writing area to which a same inclination value is to be applied to calculate the light level correction value for the specific main scanning position.

4. The apparatus of claim 2, wherein the light level controller further includes:

a comparator configured to compare the light level correction value for the specific main scanning position calculated by the signal value calculator with a limit value previously determined to generate a comparison result, and when the comparison result indicates that the light level correction value for the specific main scanning position exceeds the limit value, the light level controller is configured to output a light level control signal having the limit value while causing the signal value calculator to continue to calculate the light level correction value for the specific main scanning position based on the light level correction data and retain the calculated value.

5. The apparatus of claim 2, further comprising:

a face detector configured to output a face detection signal, the face detection signal being used to indicate a specific surface of a plurality of surfaces of the rotatable deflector that scans the light beam irradiated by the light source after the synchronization detection signal is output; and a face correction storage unit configured to store face correction data indicating a change in the light level correction value according to the specific surface of the rotatable deflector that scans the light beam;

wherein the light level controller is further configured to correct the light level correction value for the specific main scanning position calculated by the signal value calculator using the face correction data to generate a corrected light level correction value, and to cause the light source to irradiate the light beam having a light level determined based on the corrected light level correction value.

6. The apparatus of claim 1, further comprising:

a user interface configured to allow a user to set or modify the initial light level correction value stored in the storage unit.

7. An optical writing unit, comprising:

the light level controlling apparatus of claim 1.

8. The optical writing unit of claim 7, further comprising:

a photoconductor that includes the image writing area.

9. The optical writing unit of claim 7, further comprising:

a collimator lens;

wherein the light beam from the light source passes through the collimator lens as the light beam travels to the rotatable deflector.

10. The optical writing unit of claim 7, further comprising:

a cylindrical lens;

wherein the light beam from the light source passes through the cylindrical lens as the light beam travels to the rotatable deflector.

11. The optical writing unit of claim 7, further comprising:

an f-Θ lens;

wherein the light beam from the rotatable deflector passes through the f-Θ lens as the light beam travels to the image writing area.

12. The optical writing unit of claim 7, further comprising:

a deflective mirror;

wherein the light beam from the rotatable deflector reflects from the deflective mirror as the light beam travels to the image writing area.

13. A multi-function apparatus, comprising:

the optical writing unit of claim 7.

14. A multi-function apparatus, comprising:

the light level controlling apparatus of claim 1.

15. A light level controlling method, comprising:

rotating a rotatable deflector to scan a light beam irradiated by a light source to an image writing area in a main scanning direction to form an image on the image writing area;

outputting a synchronization detection signal indicating a time when the light beam scanned by the rotatable deflector enters the image writing area;

storing light level correction data including:

an initial light level correction value indicating an initial light level of the light beam to be irradiated by the light source when the light beam enters the image writing area after the synchronization detection signal is output; and light level change information indicating a change in a light level correction value for a specific main scanning position with respect to the initial light level correction value, the light level correction value for the specific main scanning position indicating a light level of the light beam to be irradiated by the light source when the light beam scans at the specific main scanning position of the image writing area; and causing the light source to irradiate the light beam having the light level determined based on the light level correction value for the specific main scanning position;

wherein the light level change information of the light level correction data includes:

inclination amount data indicating a degree of change in the light level correction value with respect to the initial light level correction value or a preceding light level correction value, the preceding light level correction value indicating a light level of the light beam to be irradiated onto a preceding main scanning position of the image writing area that precedes the specific main scanning position; and inclination direction data indicating a direction of change in the light level correction value with respect to the initial light level correction value or the preceding light level correction value.

16. The method of claim 15, wherein causing the light source to irradiate the light beam includes:

obtaining an inclination value based on the inclination amount data and the inclination direction data; and calculating the light level correction value for the specific main scanning position by adding or subtracting the inclination value to or from the initial light level correction value or the preceding light level correction value.

17. The method of claim 16, wherein the light level change information of the light level correction data further includes:

data indicating a divided area of the image writing area to which a same inclination value is to be applied to calculate the light level correction value for the specific main scanning position.

18. The method of claim 16, wherein causing the light source to irradiate the light beam further includes:

comparing the light level correction value for the specific main scanning position with a limit value previously determined to generate a comparison result;

outputting a light level control signal having the limit value when the comparison result indicates that the light level correction value for the specific main scanning position exceeds the limit value;

continuing to calculate the light level correction value for the specific main scanning position based on the light level correction data; and retaining the calculated value.

19. The method of claim 16, further comprising:

outputting a face detection signal, the face detection signal being used to indicate a specific surface of a plurality of surfaces of the rotatable deflector that scans the light beam irradiated by the light source after the synchronization detection signal is output;

storing face correction data indicating a change in the light level correction value according to the specific surface of the rotatable deflector that scans the light beam; and correcting the light level correction value for the specific main scanning position using the face correction data to generate a corrected light level correction value, wherein the light source is caused to irradiate the light beam having a light level determined based on the corrected light level correction value.

20. A recording medium storing a plurality of instructions which cause a computer to perform a light level controlling method, the method comprising:

rotating a rotatable deflector to scan a light beam irradiated by a light source to an image writing area in a main scanning direction to form an image on the image writing area;

outputting a detection signal indicating a time when the light beam scanned by the rotatable deflector enters the image writing area;

storing light level correction data including:

an initial light level correction value indicating an initial light level of the light beam to be irradiated by the light source when the light beam enters the image writing area after the synchronization detection signal is output; and light level change information indicating a change in a light level correction value for a specific main scanning position with respect to the initial light level correction value, the light level correction value for the specific main scanning position indicating a light level of the light beam to be irradiated by the light source when the light beam scans at the specific main scanning position of the image writing area; and causing the light source to irradiate the light beam having the light level determined based on the light level correction value for the specific main scanning position;

wherein the light level change information of the light level correction data includes:

inclination amount data indicating a degree of change in the light level correction value with respect to the initial light level correction value or a preceding light level correction value, the preceding light level correction value indicating a light level of the light beam to be irradiated onto a preceding main scanning position of the image writing area that precedes the specific main scanning position; and inclination direction data indicating a direction of change in the light level correction value with respect to the initial light level correction value or the preceding light level correction value.

* * * * *